US007079102B2

(12) United States Patent
Miyachi

(10) Patent No.: US 7,079,102 B2
(45) Date of Patent: Jul. 18, 2006

(54) DRIVING METHOD FOR LIQUID CRYSTAL DISPLAY APPARATUS AND LIQUID CRYSTAL DISPLAY APPARATUS

(75) Inventor: Koichi Miyachi, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 346 days.

(21) Appl. No.: 10/395,214

(22) Filed: Mar. 25, 2003

(65) Prior Publication Data

US 2003/0179172 A1 Sep. 25, 2003

(30) Foreign Application Priority Data

Mar. 25, 2002 (JP) ..... 2002-083527

(51) Int. Cl.
*G09G 3/36* (2006.01)

(52) U.S. Cl. ..... 345/94; 345/87; 345/89; 345/92

(58) Field of Classification Search ..... 345/87–100, 345/205, 690–692
See application file for complete search history.

(56) References Cited

U.S. PATENT DOCUMENTS 4,386,352 A * 5/1983 Nonomura et al. ..... 345/92
5,686,932 A * 11/1997 Tomita ..... 345/94
6,115,018 A * 9/2000 Okumura et al. ..... 345/95
6,489,952 B1 * 12/2002 Tanaka et al. ..... 345/87
6,498,595 B1 * 12/2002 Knapp et al. ..... 345/94
6,724,358 B1 * 4/2004 Ban et al. ..... 345/92
6,791,523 B1 * 9/2004 Fujita et al. ..... 345/92
2001/0011979 A1 * 8/2001 Hasegawa et al. ..... 345/87
2002/0154084 A1 * 10/2002 Tanaka et al. ..... 345/92
2005/0088398 A1 * 4/2005 Lee ..... 345/100

FOREIGN PATENT DOCUMENTS

JP 03035218 2/1991
JP 04145490 5/1992
JP 11218736 8/1999

* cited by examiner

*Primary Examiner*—Bipin Shalwala
*Assistant Examiner*—David L. Lewis
(74) *Attorney, Agent, or Firm*—Harness, Dickey & Pierce, P.L.C.

(57) ABSTRACT

In an active matrix liquid crystal display apparatus, the potentials of a source signal, the terminal of a storage capacitor other than the terminal connected to a pixel electrode, and a counter electrode are set so that the relationship between a potential difference from the potential of the other terminal of the storage capacitor to the potential of the counter electrode varies repeatedly. Further, the absolute value of a first voltage applied between the pixel electrode and the counter electrode when the potential difference is the same as that during writing of a charge to the pixel electrode, and the absolute value of a second voltage applied between the pixel electrode and the counter electrode when the potential difference is different from that during writing of a charge to the pixel electrode is determined to make the effective voltage applied to a liquid crystal capacitor during display of a predetermined gray-scale level by a moving image different from an effective voltage applied to the liquid crystal capacitor during display of the predetermined gray-scale level by a still image.

27 Claims, 16 Drawing Sheets

Potential of source signal
Potential of counter common electrode
Potential of storage capacitor line Vs(+)
0V
Vs(-)
Δ

N-th row
(N+1) th row
(N+2) th row
(N+3) th row

N-th, (N+2) th rows
(N+1) th, (N+3) th rows
0V
Vs'(+)
Vs(+)
Vs(-)
Vs'(-)

Cs / CLC0+Cs · Δ
Cs / CLC1+Cs · Δ
VLC
Vs
Gate on 1frame

DRIVING METHOD FOR LIQUID CRYSTAL DISPLAY APPARATUS AND LIQUID CRYSTAL DISPLAY APPARATUS

The present application hereby claims priority under 35 U.S.C. §119 on Japanese patent application number 2002-083527 filed Mar. 25, 2002, the entire contents of which are hereby incorporated by reference.

FIELD OF THE INVENTION

The present invention generally relates to a driving method for an active matrix liquid crystal display apparatus and such a liquid crystal display apparatus.

BACKGROUND OF THE INVENTION

In recent years, active matrix liquid crystal display apparatuses having thin film transistors (TFTs) as the switching elements have achieved widespread use. In this type of liquid crystal display apparatus, a liquid crystal layer is interposed between a TFT substrate and a counter substrate. The TFT substrate includes a plurality of gate lines running in parallel and a plurality of source lines running in parallel in the direction crossing the gate lines at right angles. Pixel electrodes, which constitute respective pixels, are provided to correspond to the respective crossings of the gate lines and the source lines, forming a matrix as a whole. A TFT is provided for each of the pixel electrodes, so that the gate electrode, source electrode and drain electrode of the TFT are respectively connected to the gate line, the source line and the pixel electrode. A storage capacitor is formed for each pixel electrode with one terminal connected to the pixel electrode. The other terminal of the storage capacitor is connected to the adjacent gate line ($C_S$-on-gate type) or a storage capacitor line ($C_S$-on-common type). The counter substrate includes a counter common electrode. A liquid crystal (LC) capacitor is formed between the pixel electrode and the counter common electrode, and the LC capacitor and the storage capacitor constitute a pixel capacitance.

In general, a liquid crystal display apparatus is slow in response. A reason is considered as follows.

In a typical active matrix liquid crystal display apparatus having TFTs as the switching elements as described above, an image is displayed in the following manner. A TFT connected to a pixel electrode is put into the selected state when a gate signal is sent to the gate electrode of the TFT via a gate line. If a source signal is sent to the source electrode of the TFT via a source line while the TFT is in the selected state, a charge is written to the pixel electrode via the drain electrode connected to the source electrode, whereby a pixel capacitor (=LC capacitor+storage capacitor $C_S$) is charged with a predetermined amount of charge. With this charging, liquid crystal molecules of the liquid crystal layer are made to take a desired aligned state. The storage capacitor functions to hold the charge amount charged in the LC capacitor. The liquid crystal layer will be short in life if it is driven with a DC voltage. For this reason and others, the source signal sent from the source electrode is reversed in polarity every charging (frame reversal) to enable drive of the liquid crystal layer with an AC voltage.

Idealistically, the charge amount charged in the pixel capacitor is desirably constant until the TFT is put into the selected state next time. The following equation is established among the charge amount Q, the pixel capacitance $C_{pixel}$ (=LC capacitance $C_{LC}$+storage capacitance $C_S$), and the voltage $V_{LC}$ applied to the LC capacitor, which is equal to the potential difference $V_S$ between the potential of the source signal and the potential of the counter electrode when the counter electrode is grounded.

$$Q=C_{pixel}\cdot V_S$$

There is a phenomenon that the dielectric constant of liquid crystal molecules increases when response from white display to black display is attempted in a normally-white TN mode, for example. That is, $C_{pixel}$(white)<$C_{pixel}$(black). Therefore, when a predetermined voltage supposed to turn the state to black display is applied to the pixel capacitor in the white display state, the voltage actually applied to the pixel capacitor is lower than the predetermined voltage due to the increase of the dielectric constant of the liquid crystal molecules (hereinafter, this phenomenon is called "voltage variation"), and thus no black display state is attained. The black display state will eventually be attained by repeating the application of this voltage (charging) several times. This is the reason why the response of liquid crystal molecules is apparently slow. Theoretically, this voltage variation occurs in every response between gray-scale levels, that is, in any moving-image display. Therefore, every response between gray-scale levels is slow due to the voltage variation.

To solve the above problem, JP 3-35218A, for example, discloses a technology of capacitance coupling in a $C_S$-on-gate type TFT liquid crystal display apparatus as follows. Two values are newly added to the conventional two-value gate signal (high potential for turning ON the TFT and low potential for turning OFF the TFT) of the gate line, to obtain a four-value signal. The newly added two values constitute a modulation signal, which is used for exchange of charge with the storage capacitor to thereby ensure application of a predetermined voltage to the pixel capacitor. In this way, the voltage variation can be reduced and, as a result, the response of liquid crystal molecules can be made faster.

However, the capacitance coupling described above has a drawback that it is not possible to reverse the pixels adjacent in the gate line direction in polarity from each other and thus flickering is likely to appear. To overcome this drawback, JP 11-218736A discloses a technology as follows. The storage capacitors of pixels arranged in the gate line direction are alternately connected to one gate line and the vertically adjacent gate line. This structure is combined with H line reversal drive in which pixels adjacent in the source line direction are reversed in polarity. By this combination, all pixels are reversed in polarity from the adjacent pixels in both the vertical and horizontal directions, and thus flickering can be reduced.

JP 4-145490A discloses the capacitance coupling for a $C_S$-on-common type liquid crystal display apparatus, in which a storage capacitor line is driven independently for each gate line so that a modulation signal is superposed on the LC capacitor, to thereby obtain substantially the same effect as that obtained by the $C_S$-on-gate type.

SUMMARY OF THE INVENTION

An object of an embodiment of the present invention is providing an active matrix liquid crystal display apparatus, excellent in response for display of a moving image.

To attain the above object, an embodiment of the present invention is directed to a driving method for an active matrix liquid crystal display apparatus. The liquid crystal display apparatus preferably includes: a device including a plurality of gate lines placed to run in parallel for carrying a gate signal sequentially, a plurality of source lines placed to run in parallel in a direction crossing the running of the plurality of gate lines at an angle for carrying a source signal, and a plurality of pixel electrodes placed to correspond to respective crossings of the gate lines and the source lines forming a matrix. Each of the pixel electrodes have a switching element, and a plurality of storage capacitors placed for the respective pixel electrodes, one of terminals of each of the storage capacitors being connected to the corresponding pixel electrode. A counter electrode faces the device and a liquid crystal layer including liquid crystal molecules, is placed between the device and the counter electrode.

The liquid crystal display apparatus is constructed so that when a gate signal is sent to a switching element via the corresponding gate line, the switching element is put into a selected state, and when a source signal is sent via the corresponding source line to the pixel electrode corresponding to the switching element in the selected state, a charge is written to the pixel electrode to allow a liquid crystal capacitor formed between the pixel electrode and the counter electrode and the storage capacitor corresponding to the pixel electrode to be charged. Potentials of the source signal, the other terminal of the storage capacitor and the counter electrode are set so that the relationship among a potential difference from the potential of the other terminal of the storage capacitor to the potential of the counter electrode, the absolute value of a first voltage applied between the pixel electrode and the counter electrode when the potential difference is the same as that given during writing of a charge to the pixel electrode, and the absolute value of a second voltage applied between the pixel electrode and the counter electrode when the potential difference is different from that given during writing of a charge to the pixel electrode is determined to make an effective voltage applied to the liquid crystal capacitor during display of a predetermined gray-scale level by a moving image different from an effective voltage applied to the liquid crystal capacitor during display of the predetermined gray-scale level by a still image.

With the driving method described above, the voltage substantially applied to the liquid crystal capacitor differs between the still-image display and the moving-image display even during display of the same gray-scale level. Due to this voltage difference, charge transfer is facilitated and thus the response of the liquid crystal molecules can be accelerated. Therefore, excellent response can be attained when a moving image is displayed by changing the gray-scale level of display.

Note that the potential of one terminal of the storage capacitor refers to the potential of the electrode of the storage capacitor connected to the pixel electrode, and the potential of the other terminal thereof refers to the potential of the electrode that is not connected to the pixel electrode. This also applies to the same wording to follow.

Alternatively, as a more concrete construction, an embodiment of the present invention is directed to a driving method for an active matrix liquid crystal display apparatus adopting an AC drive system. The liquid crystal display apparatus preferably includes a device-side substrate including a plurality of gate lines placed to run in parallel for carrying a gate signal sequentially, a plurality of source lines placed to run in parallel in a direction crossing the running of the plurality of gate lines at an angle for carrying a source signal, a plurality of pixel electrodes placed to correspond to respective crossings of the gate lines and the source lines forming a matrix, each of the pixel electrodes having a switching element, and a plurality of storage capacitors placed for the respective pixel electrodes. One of the terminals of each of the storage capacitors is connected to the corresponding pixel electrode. A counter substrate including a counter electrode, is placed to face the device-side substrate. Further, a liquid crystal layer including liquid crystal molecules, is interposed between the device-side substrate and the counter substrate.

The liquid crystal display apparatus is constructed so that when a gate signal is sent to a switching element via the corresponding gate line, the switching element is placed into a selected state. When a source signal is sent via the corresponding source line to the pixel electrode corresponding to the switching element in the selected state, a charge is written to the pixel electrode to allow a liquid crystal capacitor formed between the pixel electrode and the counter electrode and the storage capacitor corresponding to the pixel electrode to be charged. Potentials of the source signal, the other terminal of the storage capacitor and the counter electrode are set so that a potential difference from the potential of the other terminal of the storage capacitor to the potential of the counter electrode fluctuates repeatedly and that the absolute value of a first voltage applied between the pixel electrode and the counter electrode when the potential difference is the same as that given during writing of a charge to the pixel electrode is equal to or smaller than the absolute value of a second voltage applied between the pixel electrode and the counter electrode when the potential difference is different from that given during writing of a charge to the pixel electrode.

With the driving method described above, the potential difference from the potential of the other terminal of the storage capacitor to the potential of the counter electrode fluctuates repeatedly, and the absolute value of the first voltage applied between the pixel electrode and the counter electrode when the potential difference is the same as that given during a writing of a charge to the pixel electrode is equal to or smaller than the absolute value of the second voltage applied between the pixel electrode and the counter electrode when the potential difference is different from that given during writing of a charge to the pixel electrode.

Therefore, in display of a given gray-scale level, for example, the voltage substantially applied to the liquid crystal capacitor during display of a still image of the given gray-scale level involving no change in liquid crystal capacitance is a predetermined voltage between the first and second voltages corresponding to the liquid crystal capacitance for the given gray-scale level. On the contrary, during display of a moving image changing from a current gray-scale level to the given gray-scale level involving a change in liquid crystal capacitance, the voltage between the first and second voltages substantially applied to the liquid crystal capacitor changes because the second voltage changes with the change of the liquid crystal capacitance. This voltage is finally converged to the predetermined voltage substantially applied to the liquid crystal capacitor during display of the still image of the given gray-scale level. In other words, the voltage substantially applied to the liquid crystal capacitor differs between the still-image display and the moving-image display even during display of the same gray-scale level. Due to this voltage difference, charge transfer is facilitated and thus the response of the liquid crystal molecules can be accelerated. Therefore, excellent response can be attained when a moving image is displayed by changing the gray-scale level of display.

In the driving method of an embodiment of the invention, the potentials of the other terminal of the storage capacitor and the counter electrode may be set so that the potential difference from the potential of the other terminal of the storage capacitor to the potential of the counter electrode forms a waveform of which the relatively low part corresponds to a written positive charge to the pixel electrode and the relatively high part corresponds to a written negative charge to the pixel electrode.

Typically, for example, a rectangular wave may be formed by the potential difference from the other terminal of the storage capacitor to the potential of the counter electrode.

In the case described above, the potential difference from the potential of the other terminal of the storage capacitor to the potential of the counter electrode may be set to have a frequency to which the liquid crystal molecules of the liquid crystal layer cannot respond.

If the potential difference has a frequency to which the liquid crystal molecules of the liquid crystal layer can respond, flickering may occur by the response of the liquid crystal molecules to a change in potential difference, degrading the display quality. By setting as described above, however, with no such response, the occurrence of flickering is prevented.

In the driving method of an embodiment of the invention, the frequency of the potential difference may be the same as a horizontal frequency of the liquid crystal display apparatus.

By the above setting, the frequency can be high enough to ensure the inability of response of the liquid crystal molecules of the liquid crystal layer. In addition, the driving circuit can be simplified.

In the driving method of an embodiment of the invention, when the potentials of the other terminal of the storage capacitor and the counter electrode are set so that the amplitude of the waveform of the potential difference is $\Delta(\Delta>0)$, the potential of the source signal may be set so that relational expression (1) below, representing a potential difference $V_S$ between the potential of the source signal and the potential of the counter electrode, is satisfied during a written positive charge to the pixel electrode. Further, the relational expression (2) below representing the potential difference $V_S$ is satisfied during a written negative charge to the pixel electrode:

$$V_S = \sqrt{V_{LC}^2 - \left(\frac{C_S}{C_{LC}+C_S}\cdot\Delta\right)^2} - \frac{C_S}{C_{LC}+C_S}\cdot\Delta \tag{1}$$

$$V_S' = -\sqrt{V_{LC}^2 - \left(\frac{C_S}{C_{LC}+C_S}\cdot\Delta\right)^2} + \frac{C_S}{C_{LC}+C_S}\cdot\Delta \tag{2}$$

where $C_{LC}$ is the capacitance of the liquid crystal capacitor, $V_{LC}$ is a voltage to be applied in correspondence with $C_{LC}$, and $C_S$ is the capacitance of the storage capacitor.

By above setting, the function according to an embodiment of the invention can work in a more concrete way. This method is effective for the case that TFTs are used as the switching elements and a gate-drain parasitic capacitance is negligible. Note that the amplitude $\Delta$ refers to a half value of the peak-to-peak voltage of the waveform described above. This also applies to the same wording to follow.

In the case described above, the potentials of the other terminal of the storage capacitor and the counter electrode may be set so that the amplitude $\Delta$ of the waveform of the potential difference satisfies relational expression (3):

$$\Delta = \frac{C_{\mathrm{LC_min}} + C_S}{C_S}\cdot V_{\mathrm{LC_min}} \tag{3}$$

where $C_{LC_min}$ is the minimum capacitance of the liquid crystal capacitor and $V_{LC_min}$ is a voltage to be applied in correspondence with $C_{LC_min}$.

By the above setting, the difference of the voltage applied between the pixel electrode and the counter electrode between during still-image display and during moving-image display can be largest, maximizing the effect of facilitating charge transfer. Thus, the response of the liquid crystal molecules can be most accelerated.

In the driving method of an embodiment of the invention, the switching element may be a thin film transistor having a gate electrode, a source electrode and a drain electrode connected to the gate line, the source line and the pixel electrode, respectively. When the potentials of the other terminal of the storage capacitor and the counter electrode are set so that the amplitude of the waveform of the potential difference is $\Delta(\Delta>0)$, the potential of the source signal may be set so that relational expression (4) below representing a potential difference $V_S$ between the potential of the source signal and the potential of the counter electrode is satisfied during a written positive charge to the pixel electrode and wherein relational expression (5) below representing the potential difference $V_S$ is satisfied during a written negative charge to the pixel electrode:

$$V_S = \sqrt{V_{LC}^2 - \left(\frac{C_S}{C_{total}}\cdot\Delta\right)^2} - \frac{C_S}{C_{total}}\cdot\Delta + \frac{C_{gd}}{C_{total}}(V_{gh} - V_{gl}) \tag{4}$$

$$V_S = -\sqrt{V_{LC}^2 - \left(\frac{C_S}{C_{total}}\cdot\Delta\right)^2} + \frac{C_S}{C_{total}}\cdot\Delta + \frac{C_{gd}}{C_{total}}(V_{gh} - V_{gl}) \tag{5}$$

where $C_{LC}$ is the capacitance of the liquid crystal capacitor, $V_{LC}$ is a voltage to be applied in correspondence with $C_{LC}$, $C_S$ is the capacitance of the storage capacitor, $C_{gd}$ is a parasitic capacitance between the gate electrode and the drain electrode, $C_{total}$ is equal to $C_{LC}+C_S+C_{gd}$, $V_{gh}$ is a potential of the gate electrode in the selected state, and $V_{gl}$ is a potential of the gate electrode in the non-selected state.

By the above setting, the function according to an embodiment of the invention can work in a more concrete way even when TFTs are used as the switching elements and a gate-drain parasitic capacitance is not negligible.

In the case described above, the potentials of the other terminal of the storage capacitor and the counter electrode may be set so that the amplitude $\Delta$ of the waveform of the potential difference satisfies relational expression (6):

$$\Delta = \frac{C_{\mathrm{LC_min}} + C_S + C_{gd}}{C_S}\cdot V_{\mathrm{LC_min}} \tag{6}$$

where $C_{LC_min}$ is the minimum capacitance of the liquid crystal capacitor and $V_{LC_min}$ is a voltage to be applied in correspondence with $C_{LC_min}$.

By the above setting, the difference of the voltage applied between the pixel electrode and the counter electrode between during still-image display and during moving-image display can be largest, maximizing the effect of facilitating charge transfer. Thus, the response of the liquid crystal molecules can be most accelerated.

In the driving method of an embodiment of the invention, the liquid crystal display apparatus may be of a $C_S$-on-common type having a storage capacitor line to which the other terminal of the storage capacitor is connected.

In the case described above, in the liquid crystal display apparatus, when the other terminals of the storage capacitors arranged along the running of each gate line are connected to the same storage capacitor line, while the switching elements adjacent in the direction of the running of the gate lines are connected to different gate lines, charges of different polarities may be written during charging of the pixel electrodes of one frame to the pixel electrodes adjacent in the direction of the running of the gate lines by putting the switching elements adjacent in the direction of the running of the gate lines into the selected state with a gate signal via different gate lines.

By the above arrangement, charges of different polarities are written to the pixel electrodes adjacent in the direction of the running of the gate lines. This can suppress occurrence of flickering in this direction. In addition, by combining this with the H line reversal drive, occurrence of flickering in the direction of the running of the source lines can also be suppressed.

In the driving method of an embodiment of the invention, in the liquid crystal display apparatus, when the switching elements arranged along the running of each gate line are connected to the same gate line, while the other terminals of the storage capacitors adjacent in the direction of the running of the gate lines are connected to different storage capacitor lines, charges of different polarities may be written during charging of the pixel electrodes of one frame to the pixel electrodes adjacent in the direction of the running of the gate lines by putting the switching elements arranged along the running of the gate line into the selected state with a gate signal of the same gate line and sending source signals opposite in phase to the adjacent pixel electrodes placed in correspondence with the switching elements.

By the above arrangement, charges of different polarities are written to the pixel electrodes adjacent in the direction of the running of the gate lines. This can suppress occurrence of flickering in this direction. In addition, the switching elements arranged along the running of each gate line are put into the selected state with a gate signal via the same gate line. In other words, charges are written to the pixel electrodes corresponding to these switching elements simultaneously. This eliminates the necessity of a line memory, which will be necessary if the switching elements arranged along the running of each gate line are divided into groups and put into the selected state with a gate signal via different gate lines. By combining this with the H line reversal drive, occurrence of flickering in the direction of the running of the source lines can also be suppressed.

In the case described above, in the liquid crystal display apparatus, all of the other terminals of the storage capacitors corresponding to the pixel electrodes to which charges of the same polarity are written during charging of the pixel electrodes of one frame may be connected together via a storage capacitor line.

By the above arrangement, the storage capacitor lines may be grouped into two types and connected together for each type. This simplifies the construction of the liquid crystal display apparatus, and also facilitates the control because only the control of the two types of storage capacitor lines is required.

In the driving method of an embodiment of the invention, in the liquid crystal display apparatus, the storage capacitor line may be placed between every two adjacent gate lines, one terminal of each of the storage capacitors may be connected to an edge of the corresponding pixel electrode, the other terminal of the storage capacitor being connected to the corresponding storage capacitor line, and the pixel electrode may be formed over the gate line with an insulating film interposed between the pixel electrode and the gate line for blocking formation of a capacitance between the pixel electrode and the gate line.

By the above arrangement, formation of a capacitance between the gate line and the pixel electrode is blocked although the pixel electrode is placed over the gate line, and thus normal writing of a charge to the pixel electrode is attained.

In the driving method of an embodiment of the invention, the liquid crystal display apparatus may be of a $C_S$-on-gate type in which the other terminal of the storage capacitor is connected to a gate line other than the gate line corresponding to the storage capacitor.

The liquid crystal display apparatus driven by the method of an embodiment of the present invention is an active matrix liquid crystal display apparatus. Thus, it preferably includes: a device including a plurality of gate lines placed to run in parallel for carrying a gate signal sequentially, a plurality of source lines placed to run in parallel in a direction crossing the running of the plurality of gate lines at an angle for carrying a source signal, and a plurality of pixel electrodes placed to correspond to respective crossings of the gate lines and the source lines forming a matrix. Each of the pixel electrodes include a switching element, and a plurality of storage capacitors placed for the respective pixel electrodes. One of the terminals of each of the storage capacitors is connected to the corresponding pixel electrode. A counter electrode faces the device. Further, a liquid crystal layer including liquid crystal molecules, is placed between the device and the counter electrode.

The liquid crystal display apparatus is constructed so that when a gate signal is sent to a switching element via the corresponding gate line, putting the switching element into a selected state, and a source signal is sent via the corresponding source line to the pixel electrode corresponding to the switching element in the selected state, a charge is written to the pixel electrode. This allows a liquid crystal capacitor formed between the pixel electrode and the counter electrode and the storage capacitor corresponding to the pixel electrode to be charged. Potentials of the source signal, the other terminal of the storage capacitor and the counter electrode are set so that the relationship among a potential difference from the potential of the other terminal of the storage capacitor to the potential of the counter electrode, the absolute value of a first voltage applied between the pixel electrode and the counter electrode when the potential difference is the same as that given during a written charge to the pixel electrode, and the absolute value of a second voltage applied between the pixel electrode and the counter electrode when the potential difference is different from that given during a written charge to the pixel electrode is determined to make an effective voltage applied to the liquid crystal capacitor during display of a predetermined gray-scale level by a moving image different from an effective voltage applied to the liquid crystal capacitor during display of the predetermined gray-scale level by a still image.

Alternatively, as a more concrete construction, the liquid crystal display apparatus driven by the method of an embodiment of the present invention is an active matrix liquid crystal display apparatus adopting an AC drive system. It includes: a device-side substrate including a plurality of gate lines placed to run in parallel for carrying a gate signal sequentially, a plurality of source lines placed to run in parallel in a direction crossing the running of the plurality of gate lines at an angle for carrying a source signal, and a plurality of pixel electrodes placed to correspond to respective crossings of the gate lines and the source lines forming a matrix. Each of the pixel electrodes include a switching element. A plurality of storage capacitors are placed for the respective pixel electrodes. One of the terminals of each of the storage capacitors is connected to the corresponding pixel electrode. A counter substrate including a counter electrode, is placed to face the device-side substrate. A liquid crystal layer including liquid crystal molecules, is interposed between the device-side substrate and the counter substrate.

The liquid crystal display apparatus is constructed so that when a gate signal is sent to a switching element via the corresponding gate line, putting the switching element into a selected state, and a source signal is sent via the corresponding source line to the pixel electrode corresponding to the switching element in the selected state, a charge is written to the pixel electrode to allow a liquid crystal capacitor formed between the pixel electrode and the counter electrode and the storage capacitor corresponding to the pixel electrode to be charged. Potentials of the source signal, the other terminal of the storage capacitor and the counter electrode are set so that a potential difference from the potential of the other terminal of the storage capacitor to the potential of the counter electrode fluctuates repeatedly. Further, the absolute value of a first voltage applied between the pixel electrode and the counter electrode when the potential difference is the same as that given during a written charge to the pixel electrode is equal to or smaller than the absolute value of a second voltage applied between the pixel electrode and the counter electrode when the potential difference is different from that given during a written charge to the pixel electrode.

The liquid crystal display apparatus of an embodiment of the invention may be of a $C_S$-on-common type having a storage capacitor line to which the other terminal of the storage capacitor is connected.

In the case described above, when the other terminals of the storage capacitors arranged along the running of each gate line are connected to the same storage capacitor line, while the switching elements adjacent in the direction of the running of the gate lines are connected to different gate lines, charges of different polarities may be written during charging of the pixel electrodes of one frame to the pixel electrodes adjacent in the direction of the running of the gate lines by putting the switching elements adjacent in the direction of the running of the gate lines into the selected state with a gate signal via different gate lines.

In the liquid crystal display apparatus of an embodiment of the invention, when the switching elements arranged along the running of each gate line are connected to the same gate line, while the other terminals of the storage capacitors adjacent in the direction of the running of the gate lines are connected to different storage capacitor lines, charges of different polarities may be written during charging of the pixel electrodes of one frame to the pixel electrodes adjacent in the direction of the running of the gate lines by putting the switching elements arranged along the running of the gate line into the selected state with a gate signal of the same gate line and sending source signals opposite in phase to the adjacent pixel electrodes placed in correspondence with the switching elements.

In the case described above, all of the other terminals of the storage capacitors corresponding to the pixel electrodes to which charges of the same polarity are written during charging of the pixel electrodes of one frame may be connected together via a storage capacitor line.

In the liquid crystal display apparatus of an embodiment of the invention, the storage capacitor line may be placed between every two adjacent gate lines, one terminal of each of the storage capacitors may be connected to an edge of the corresponding pixel electrode, the other terminal of the storage capacitor being connected to the corresponding storage capacitor line. Further, the pixel electrode may be formed over the gate line with an insulating film interposed between the pixel electrode and the gate line for blocking formation of a capacitance between the pixel electrode and the gate line.

The liquid crystal display apparatus of an embodiment of the invention may be of a $C_S$-on-gate type in which the other terminal of the storage capacitor is connected to a gate line other than the gate line corresponding to the storage capacitor.

BRIEF DESCRIPTION OF THE DRAWINGS

Other objects, features and advantages of the invention will be apparent from the following description of exemplary embodiments taken in connection with the accompanying drawings, noting that the present invention is not limited to the aforementioned embodiments.

DETAILED DESCRIPTION OF THE PREFERRED EMBODIMENTS

Hereinafter, preferred embodiments of the present invention will be described with reference to the accompanying drawings. The embodiments are merely illustrative of various aspects of the invention and the invention should not be considered limited to the preferred embodiments.

Embodiment 1

<Construction of liquid Crystal Display Apparatus>

Figure 1:
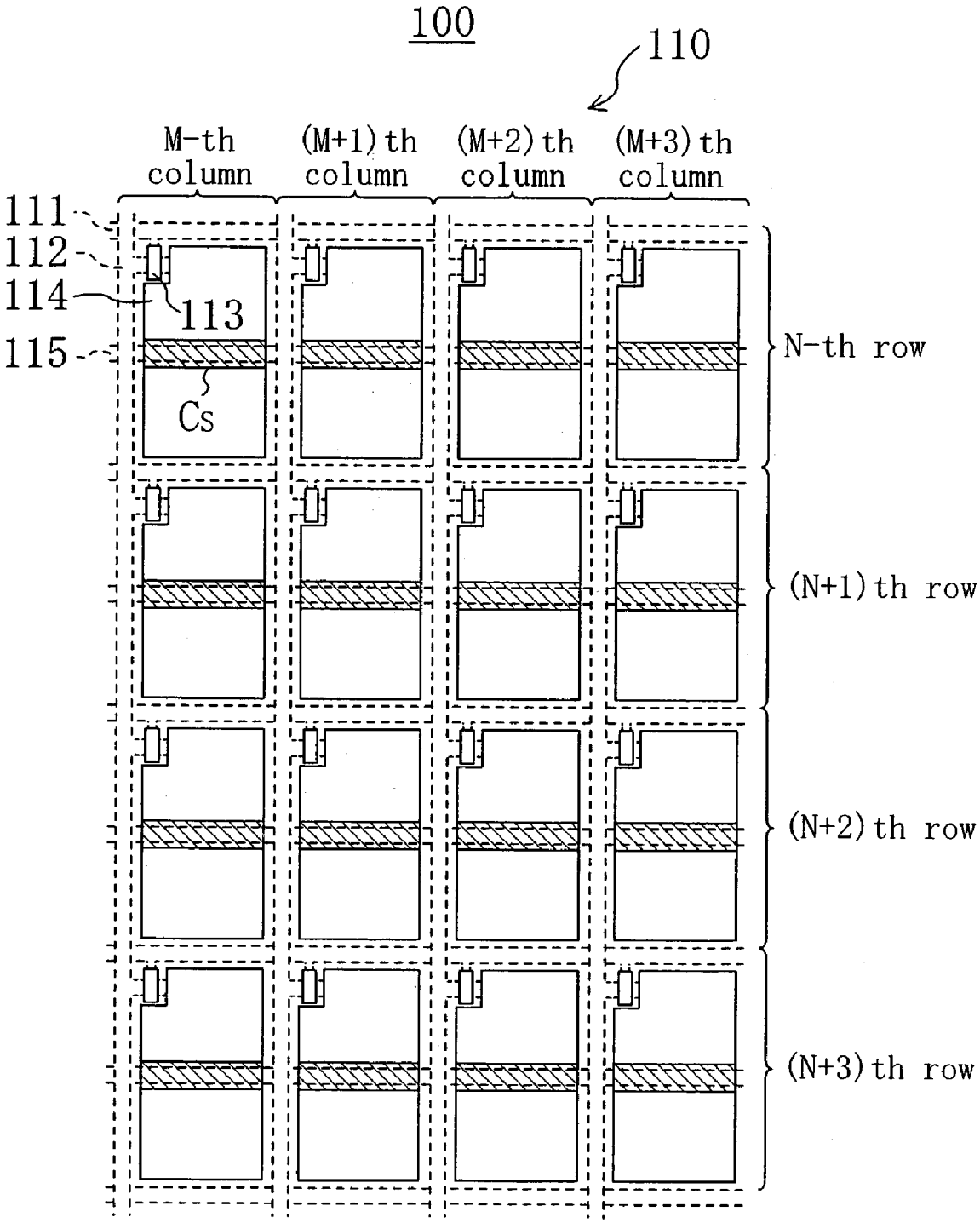
FIG. 1 is a front view of a TFT substrate of a liquid crystal display apparatus of Embodiment 1 of the present invention.
Figure 2:
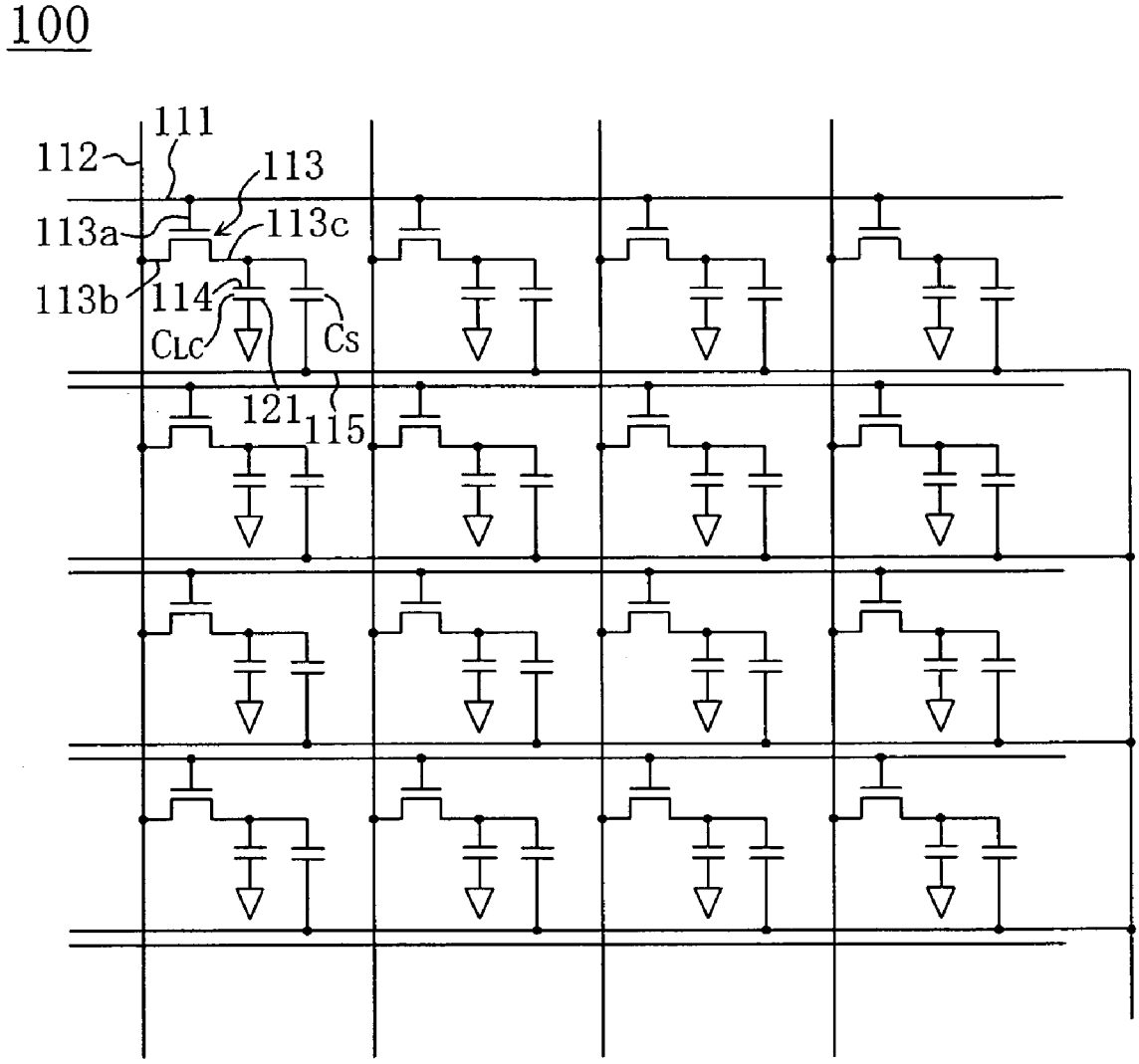
FIG. 2 is an equivalent circuit diagram of the liquid crystal display apparatus of Embodiment 1.

FIGS. 1 and 2 show a liquid crystal display apparatus 100 of Embodiment 1 of the present invention. The liquid crystal display apparatus 100 includes a TFT substrate (device-side substrate) 110, a counter substrate facing the TFT substrate 110 and a liquid crystal layer interposed between the two substrates.

The TFT substrate 110 includes: a plurality of gate lines 111 formed to run in parallel on the inner surface of a glass or plastic substrate body; and a plurality of source lines 112 formed to run in parallel in the direction crossing the gate lines 111 at right angles as a different layer from the layer of the gate lines 111 with an insulator there between. The TFT substrate 110 also includes a plurality of roughly rectangular pixel electrodes 114 formed as a different layer from the layers of the gate lines 111 and the source lines 112 with an insulator there between. The pixel electrodes 114, made of a transparent material such as ITO (a columnar crystalline oxide including indium oxide and tin oxide as main components), are formed to correspond to the respective crossings of the gate lines 111 and the source lines 112, and each extends over the area surrounded by the two adjacent gate lines 111 and the two adjacent source lines 112.

The plurality of pixel electrodes 114 are therefore arranged in a matrix as a whole. TFrs 113 are formed as the switching elements at corners of the pixel electrodes 114 close to the crossings of the gate lines 111 and the source lines 112. Each of the TFTs 113 has a gate electrode 113*a*, a source electrode 113*a* and a drain electrode 113*c* respectively connected to the corresponding gate line 111, source line 112 and pixel electrode 114.

Storage capacitor lines 115 are formed from the same layer as the gate lines 111 so that each storage capacitor line runs in parallel with the gate lines 111 between the adjacent gate lines 111. Portions of the insulator interposed between the pixel electrodes 114 and the storage capacitor lines 115 constitute storage capacitors $C_S$ each connected to the pixel electrode 114 at one terminal and the storage capacitor line 115 at the other terminal. The liquid crystal display apparatus 100 of this embodiment is therefore of the $C_S$-on-common type. All of the storage capacitor lines 115, each running between the adjacent gate lines 111, are connected together. A rubbed alignment layer is placed on the pixel electrodes 114 on the inner surface of the substrate body, and a polarizer is placed on the outer surface of the substrate body.

The counter substrate includes a counter common electrode (counter electrode) 121 made of a transparent material such as ITO formed on the inner surface of a glass or plastic substrate body. An RGB color filter for color display and a rubbed alignment layer are placed on the inner surface of the substrate body, and a phase plate, a polarizer and an anti-reflection film are placed on the outer surface of the substrate body for control of the state of incident light.

The liquid crystal layer includes liquid crystal molecules of dielectric nematic liquid crystal and the like.

The liquid crystal display apparatus 100 having the construction described above is of the active matrix type in which one pixel is defined by each pixel electrode 114 having the TFT 113 as the switching element, and is constructed to operate as follows. A TFT 113 is put into the selected state when a gate signal is sent to the TFT 113 via the gate line 111. If a source signal is sent to the TF 113 via the source line 112 while the TFT 113 is in the selected state, a charge is written to the corresponding pixel electrode 114. By such a charge being written, the LC capacitor $C_{LC}$ formed between the pixel electrode 114 and the counter common electrode 121 and the storage capacitor $C_S$, that is, the pixel capacitor composed of these capacitors, is charged. By controlling the charge amount to the LC capacitor $C_{LC}$, the aligned state of the liquid crystal molecules is adjusted, to thereby control the light transmittance and thus attain display.

<Driving Method 1 for Liquid Crystal Display Apparatus>

The first driving method for the liquid crystal display apparatus 100 will be described.

Figures 3A, 3B, 3C, 3D:
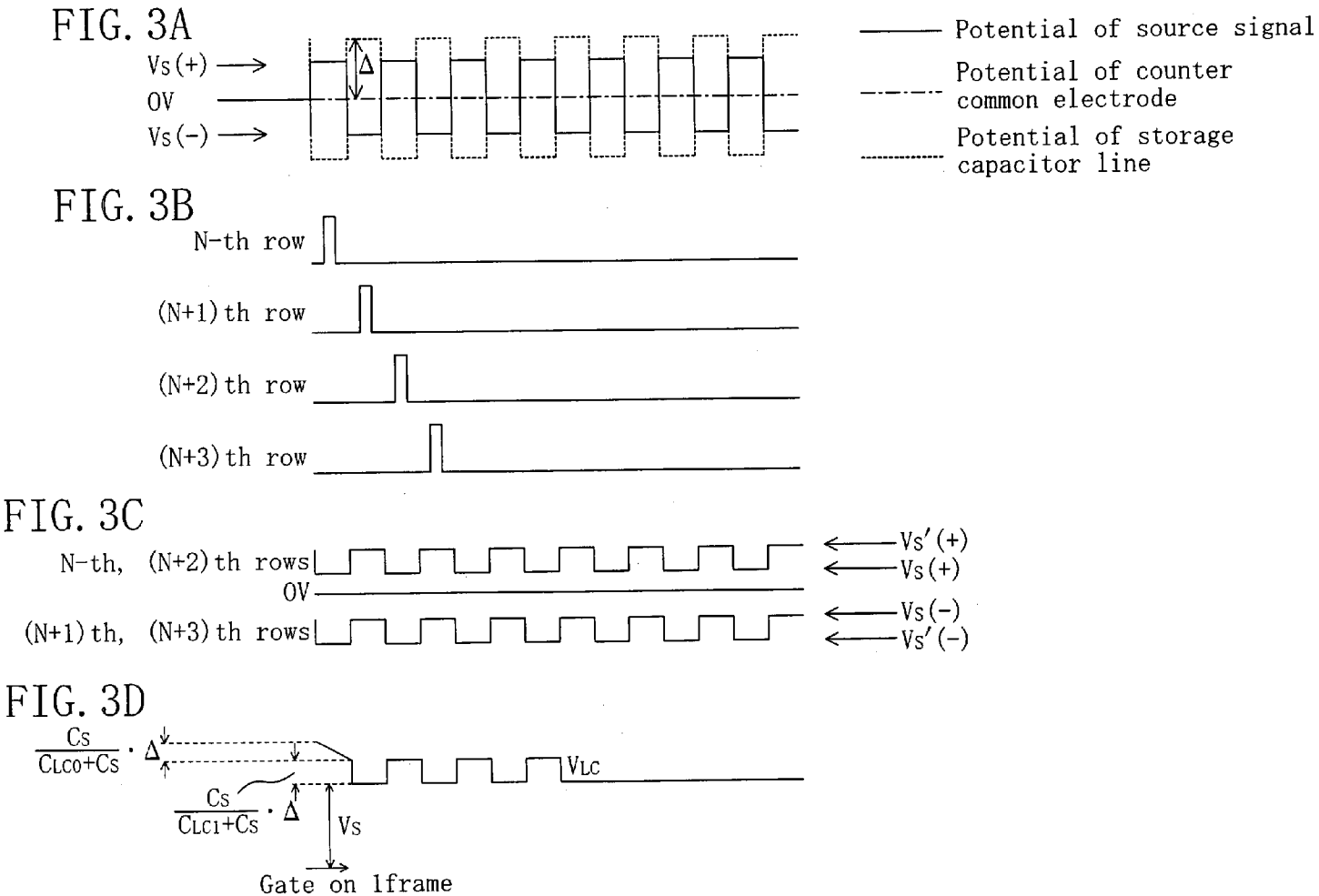
FIG. 3A is a diagram of waveforms of the potentials of a source line, a storage capacitor line and a counter common electrode.
FIG. 3B is a diagram of waveforms of the potentials of the N-th to (N+3)th gate lines.
FIG. 3C is a diagram of waveforms of the voltages applied between pixel electrodes of pixels in the N-th to (N+3)th rows and the counter common electrode.
FIG. 3*d* illustrates the varying voltage change for a moving-image display.

FIG. 3A shows waveforms of the potential $V_s$ of the source line 112, the potential $V_{cs}$ of the storage capacitor line 115, and the potential $V_{com}$ of the counter common electrode 121. FIG. 3B shows waveforms of the potentials of the N-th to (N+3)th gate lines 111. FIG. 3C shows waveforms of the voltages applied between the pixel electrodes 114 of pixels in the N-th to (N+3)th rows and the counter common electrode 121.

In the first driving method, assume that a parasitic capacitance between the gate electrode 113*a* and the drain electrode 113*c* is neglected and that the counter common electrode 121 is grounded. The potential $V_{com}$ of the counter common electrode 121 is therefore 0 V (constant) as shown in FIG. 3A.

As shown in FIG. 3B, a gate signal is sequentially sent to the N-th to (N+3)th gate lines 111. When one gate line 111 receives the gate signal, all the TFTs 113 in the same row as this gate line 111 are turned ON into the selected state, bringing the source electrode 113*b* and the drain electrode 113*c* of each TFT into conduction.

The potential $V_S$ of the source signal has a shape of an AC rectangular wave as shown in FIG. 3A. When a TFT 113 is in the ON state allowing conduction between the source electrode 113*b* and the drain electrode 113*c*, a signal voltage equal to the potential $V_S$ of the source signal is applied between the corresponding pixel electrode 114 and the counter common electrode 121 because the counter common electrode 121 is grounded, and a charge of the same polarity as the signal voltage is written to the pixel electrode 114. In this writing of a charge to the pixel electrodes 114, the source signal is controlled so that the polarity of the charge is changed every frame. In other words, the liquid crystal display apparatus 100 adopts the AC drive system, to thereby improve the reliability of the liquid crystal layer, of which life will be short if a DC voltage is applied.

Figure 4:
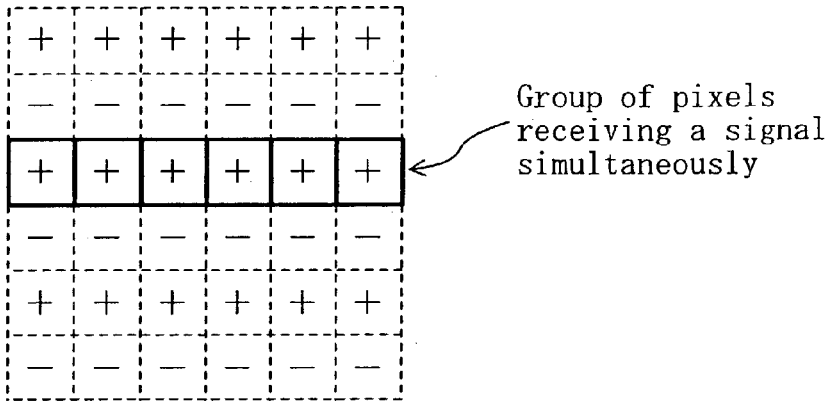
FIG. 4 is a view showing a charge polarity distribution after charging of pixel electrodes of one frame in Embodiment 1.

In addition, as shown in FIGS. 3A and 3B, for example, positive charges are written to the pixel electrodes 114 in the N-th and (N+2)th rows, while negative charges are written to the pixel electrodes 114 in the (N+1)th and (N+3)th rows. As a result, after the charging of all the pixel electrodes 114 of one frame, the charge polarity distribution is as shown in FIG. 4, in which charges of the same polarity are written to the pixel electrodes 114 arranged in the direction of the running of the gate lines 111 (gate line direction), while charges of different polarities are written to the pixel electrodes 114 adjacent in the direction of the running of the source lines 112 (source line direction). By this arrangement, the occurrence of flickering can be suppressed in the source line direction. In short, the liquid crystal display apparatus 100 of this embodiment is of the H line reversal drive system.

As shown in FIG. 3A, the potential $V_{CS}$ of the storage capacitor line 115, that is, the potential of the other terminal of the storage capacitor $C_S$ has a shape of an AC rectangular wave, of which the phase is reverse to that of the potential of the source signal. The center potential is 0 V (equal to the potential $V_{com}$ of the counter common electrode 121) and the amplitude is Δ(Δ>0). Therefore, the potential difference from the potential $V_{CS}$ of the storage capacitor line 115 to the potential $V_{com}$ of the counter common electrode 121 is represented by an AC square-wave signal voltage fluctuating between +Δ and −Δ. The frequency of this signal voltage of the potential difference is the same as that of the source signal, that is, the same as the horizontal frequency of the liquid crystal display apparatus 100. This can simplify a control circuit. In addition, because the liquid crystal molecules of the liquid crystal layer are unable to respond to this frequency, occurrence of flickering due to the fluctuation of the potential difference can be prevented.

Figure 5:
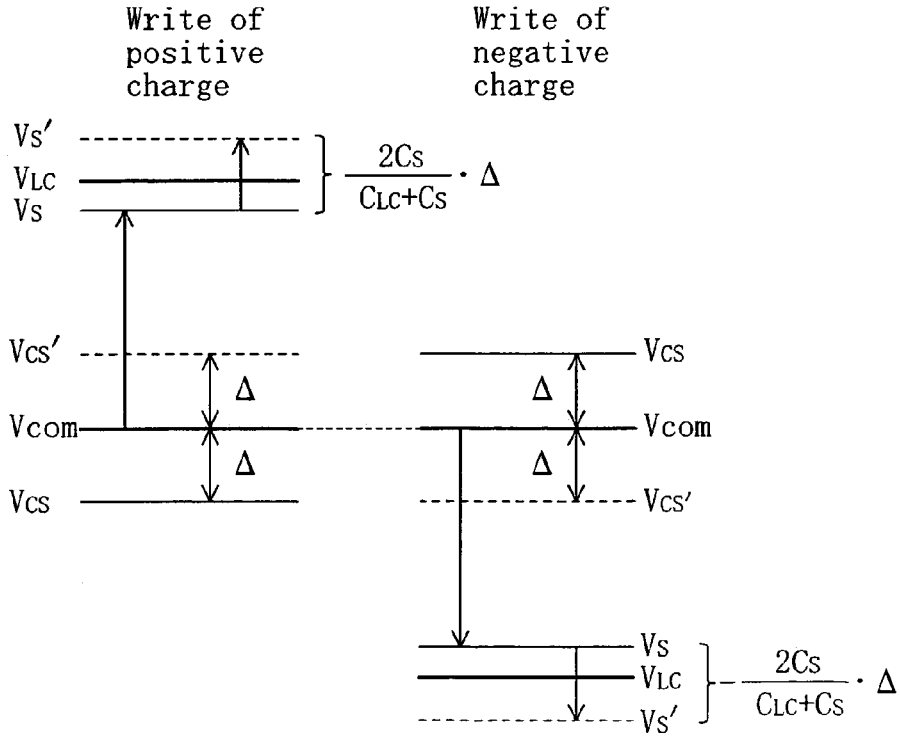
FIG. 5 is a view demonstrating a first driving method for the liquid crystal display apparatus of Embodiment 1.

Hereinafter, the operation to follow from writing of a charge to the pixel electrode 114 until next writing of a charge will be described with reference to FIG. 5.

When a charge is written to the pixel electrode 114 or when the state is the same as that given during the writing of a charge, that is, when the potential of the other terminal of the storage capacitor $C_S$ (potential $V_{CS}$ of the storage capacitor line 115) is the same as that given when charge is written to the pixel electrode 114 (−Δ when a positive charge is written and +Δ when a negative charge is written), the charge amount Qd in the drain electrode 113*c* is represented by relational expression (7):

$$Q_d = C_{LC}(V_S - 0) + C_S\{V_S - (\mp\Delta)\} \tag{7}$$

where the upper and lower parts of the complex code correspond to the writing of a positive charge and negative charge, respectively, into the pixel electrode 114 (this also applies to the same wording to follow).

When the state becomes different from that given during the writing of a charge to the pixel electrode 114 after the writing of a charge, that is, when the potential of the other terminal of the storage capacitor $C_S$ (potential $V_{cs}$ of the storage capacitor line 115) becomes different from that given during the writing of a charge to the pixel electrode 114 (+Δ when a positive charge is written and −Δ when a negative charge is written), the charge amount Qd' in the drain electrode 113*c* is represented by relational expression (8):

$$Q_d = C_{LC}(V_S - 0) + C_S\{V_S - (\pm\Delta)\} \tag{8}$$

where $V_S'$ is the potential of the pixel electrode 114 given when the potential of the other terminal of the storage capacitor $C_S$ (potential $V_{CS}$ of the storage capacitor line 115) is different from the potential given during the writing of a charge to the pixel electrode 114, and $V_{CS}'$ is the potential of the storage capacitor line 115 at that time.

Assuming that there is no leakage of charge, $Q_d = Q_d'$, which derives relational expression (9) below.

$$V_S' = V_S \pm \frac{2C_S}{C_{LC} + C_S} \cdot \Delta \tag{9}$$

Since the counter common electrode 121 is grounded, $V_S$ and $V_S'$ can be regarded equal to the voltage applied between the pixel electrode 114 and the counter common electrode 121. Therefore, after the writing of a positive or negative charge to the pixel electrode 114, the voltage $V_S$ (first voltage) is applied between the pixel electrode 114 and the counter common electrode 121 when the potential $V_{CS}$ of the storage capacitor line 115 is the same as that given during the writing of a charge to the pixel electrode 114 (−Δ when a positive charge is written and +Δ when a negative charge is written). Likewise, the voltage $V_S'$ (second voltage) is applied between the pixel electrode 114 and the counter common electrode 121 when the potential $V_{CS}$ of the storage capacitor line 115 is different from that given during the writing of a charge to the pixel electrode 114 (+Δ when positive charge is written and −Δ when negative charge is written). That is, the voltage applied between the pixel electrode 114 and the counter common electrode 121 varies between $V_S$ and $V_S'$ alternately every horizontal period.

Figure 6:
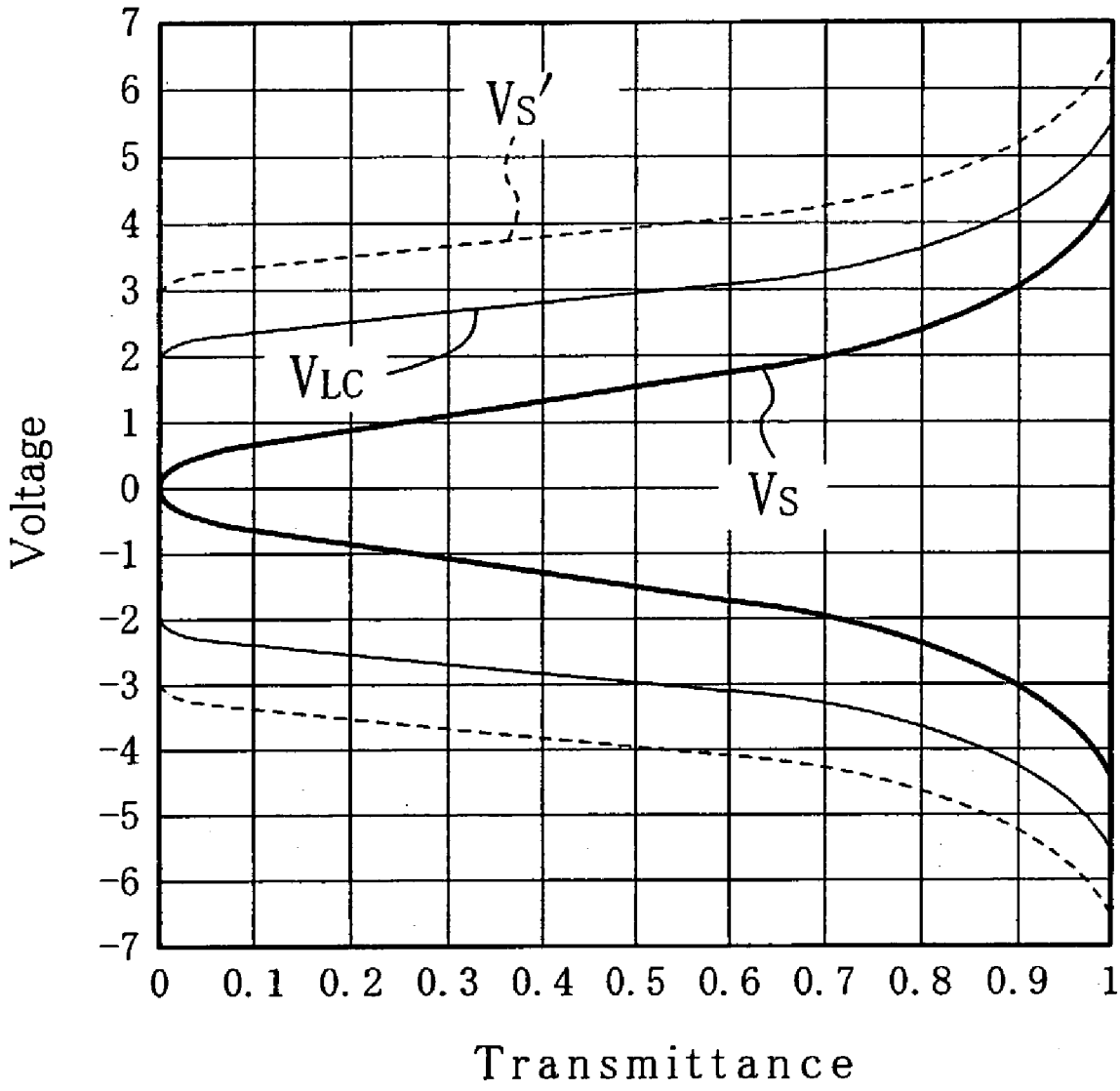
FIG. 6 is a graph showing the relationship between the transmittance and the voltage.

FIG. 6 and Table 1 below show an example of the relationship between the transmittance and the voltage. With a transmittance of 0, $V_S$ and $V_S'$ are the same in absolute value and opposite in polarity. When the transmittance is higher than 0, $V_S < V_S'$ for the writing of a positive charge, while $V_S > V_S'$ for the writing of a negative charge. That is, the absolute value of $V_S$ as the first voltage is equal to or smaller than the absolute value of $V_S'$.

Table 1

| Transmittance | LC + | $V_s$ + | $V_s'$ + | LC − | $V_s$ − | $V_s'$ − |
|---|---|---|---|---|---|---|
| 0.000 | 1.49 | −1.49 | 1.49 | −1.49 | 1.49 | −1.49 |
| 0.001 | 2.10 | 0.00 | 2.97 | −2.10 | 0.00 | −2.97 |
| 0.004 | 2.16 | 0.13 | 3.05 | −2.16 | −0.13 | −3.05 |
| 0.013 | 2.22 | 0.25 | 3.13 | −2.22 | −0.25 | −3.13 |
| 0.102 | 2.43 | 0.66 | 3.37 | −2.43 | −0.66 | −3.37 |
| 0.208 | 2.58 | 0.93 | 3.53 | −2.58 | −0.93 | −3.53 |
| 0.328 | 2.73 | 1.16 | 3.68 | −2.73 | −1.16 | −3.68 |
| 0.407 | 2.83 | 1.31 | 3.78 | −2.83 | −1.31 | −3.78 |
| 0.516 | 2.98 | 1.53 | 3.93 | −2.98 | −1.53 | −3.93 |
| 0.609 | 3.14 | 1.73 | 4.09 | −3.14 | −1.73 | −4.09 |
| 0.706 | 3.35 | 2.00 | 4.29 | −3.35 | −2.00 | −4.29 |
| 0.806 | 3.67 | 2.38 | 4.61 | −3.67 | −2.38 | −4.61 |
| 0.904 | 4.23 | 3.01 | 5.17 | −4.23 | −3.01 | −5.17 |
| 0.950 | 4.69 | 3.51 | 5.62 | −4.69 | −3.51 | −5.62 |
| 1.000 | 5.49 | 4.37 | 6.42 | −5.49 | −4.37 | −6.42 |

As shown in FIG. 3C, $V_S$ and $V_S'$ of the positive polarity are alternately applied between the pixel electrodes 114 and the counter common electrode 121 in the N-th and (N+2)th rows, while $V_S$ and $V_S'$ of the negative polarity are alternately applied between the pixel electrodes 114 and the counter common electrode 121 in the (N+1)th and (N+3)th rows. The time of application of $V_S$ to the former rows matches with the time of application of $V_S'$ to the latter rows. Likewise, the time of application of $V_S'$ to the former rows matches with the time of application of $V_S$ to the latter rows. This is because all the storage capacitor lines 115 are connected together and thus the other terminals of all the storage capacitors $C_S$ have the same potential even when the pixel electrodes 114 adjacent in the source line direction store charges of different polarities.

The voltage $V_{LC}$ actually applied to the liquid crystal layer can be represented by relational expression (10) below considering the effective values of the above voltages.

$$V_{LC} = \pm\sqrt{\frac{V_S^2 + V_S'^2}{2}} \tag{10}$$

By substituting the relational expression (9) into the above expression to obtain $V_S$, relational expression (11) below is derived.

$$V_S = \pm\sqrt{V_{LC}^2 - \left(\frac{C_S}{C_{LC} + C_S}\cdot\Delta\right)^2} \mp \frac{C_S}{C_{LC} + C_S}\cdot\Delta \tag{11}$$

Next, described will be display of a still image involving no change in the gray-scale level of display (where the capacitance of the LC capacitor is maintained at $C_{LC1}$) and display of a moving image involving change of the gray-scale level of display (where the capacitance of the LC capacitor changes from $C_{LC0}$ to $C_{LC1}$).

When a charge is written to the pixel electrode 114, or when the state is the same as that given during the writing of a charge, that is, when the potential of the other terminal of the storage capacitor $C_S$ (potential $V_{CS}$ of the storage capacitor line 115) is the same as that given when a charge is written to the pixel electrode 114, the voltage $V_{S1}$ applied between the pixel electrode 114 and the counter common electrode 121 is equal to the signal voltage of the source signal during the writing of a charge to the pixel electrode 114. Therefore, in both the still-image display and the moving-image display, relational expression (12) below is established.

$$V_{S1} = \pm\sqrt{V_{LC1}^2 - \left(\frac{C_S}{C_{LC1} + C_S}\cdot\Delta\right)^2} \mp \frac{C_S}{C_{LC1} + C_S}\cdot\Delta \tag{12}$$

However, when the state becomes different from that given during the writing of a charge to the pixel electrode 114 after the writing of a charge, that is, when the potential of the other terminal of the storage capacitor $C_S$ (potential $V_{CS}$ of the storage capacitor line 115) becomes different from that given during the writing of a charge to the pixel electrode 114, the voltage applied between the pixel electrode 114 and the counter common electrode 121 is different between the still-image display and the moving-image display.

In the still-image display (where the capacitance of the LC capacitor is maintained at $C_{LC1}$), the voltage $V_{S11}'$ applied between the pixel electrode 114 and the counter common electrode 121 is represented by relational expression (13) below.

$$V_{S11}' = V_S \pm \frac{2C_S}{C_{LC1} + C_S}\cdot\Delta \tag{13}$$

In the moving-image display (where the capacitance of the LC capacitor changes from $C_{LC0}$ to $C_{LC1}$), the voltage $V_{S01}'$ applied between the pixel electrode 114 and the counter common electrode 121 is represented by relational expression (14) below.

$$V_{S01}' = V_S \pm \frac{2C_S}{C_{LC0} + C_S}\cdot\Delta \tag{14}$$

This expression indicates that $2C_S\cdot\Delta/(C_{LC}+C_S)$ as the difference between $V_S$ and $V_S'$ changes with the change of $C_{LC}$ in the moving-image display.

In the still-image display, the effective voltage value $V_{LC11}$ applied to the LC capacitor $C_{LC}$ is represented by relational expression (15) below.

$$V_{LC11} = \pm\sqrt{\frac{V_{S1}^2 + V_{S11}'^2}{2}} \tag{15}$$

In the moving-image display, the effective voltage value $V_{LC01}$ applied to the LC capacitor $C_{LC}$ is represented by relational expression (16) below.

$$V_{LC01} = \pm\sqrt{\frac{V_{S1}^2 + V_{S01}'^2}{2}} \tag{16}$$

From the above, relational expression (17) below is established.

$$\delta V = V_{LC01} - V_{LC11} \neq 0 \tag{17}$$

That is, the effective voltage applied to the LC capacitor $C_{LC}$ is different between the still-image display and the moving-image display. Due to the existence of this voltage difference, charge transfer is facilitated and this accelerates the response of the liquid crystal molecules. As a result, excellent response can be exhibited during display of a moving image performed by changing the gray-scale level of display. Note that $C_{LC0}$ gradually changes toward $C_{LC1}$, and with this gradual change, $V_{S01}'$ is converged to $V_{S11}'$. FIG. 3*d* illustrates the varying voltage change for a moving-image display (where the capacitance of the LC capacitor changes from $C_{LC0}$ to $C_{LC1}$). $V_{LC}$ is shown as varying in an alternating fashion, wherein the value of $V_{LC}$ varies over 1 frame. Initially, the voltage $V_{LC}$ is large in the form of a voltage overshoot, to stimulate the change necessary for the moving image. The voltage is initially a combination of $$V_S \pm \frac{C_S}{C_{LC1} + C_S}\cdot\Delta \text{ and } \pm\frac{C_S}{C_{LC0} + C_S}\cdot\Delta.$$

Then, there is a gradual decrease from this combination value to the value of $$V_S \pm \frac{C_S}{C_{LCI} + C_S} \cdot \Delta$$

as shown in FIG. 3D. This occurs over one frame.

From the above discussion, it is found that $V_{LC01}$ can be higher or lower than $V_{LC11}$ in the moving-image display by adjusting the value Δ. The effect of accelerating the response of the liquid crystal molecules is proportional to the magnitude of δV. It is derived from the relational expressions (13) to (17) that to maximize this effect, Δ should be the maximum value $\Delta_{max}$. The inside of the square root of the relational expression (11) is 0 or more, and it is found from this expression that the minimum capacitance $C_{LC_min}$ of the LC capacitor $C_{LC}$ may be considered to maximize the value Δ. From this, $\Delta_{max}$ can be represented by relational expression (18):

$$\Delta_{\max} = \frac{C_{\mathrm{LC_min}} + C_S}{C_S} \cdot V_{\mathrm{LC_min}} \tag{18}$$

where $V_{LC_min}$ is the voltage to be applied to obtain $C_{LC_min}$.

By substituting the relational expression (18) into the relational expression (11), the minimum value $V_{S_min}$ of $V_S$ can be obtained by relational expression (19) below.

$$V_{\mathrm{S_min}} = \frac{C_{\mathrm{LC_min}} + C_S}{C_S} \cdot \Delta_{\max} = -V_{\mathrm{LC_min}} \tag{19}$$

This expression represents a "black" voltage in the case of the normally-black mode and a "white" voltage in the case of the normally-white mode.

Experiments were conducted using the liquid crystal display apparatus having the construction described above operating in the normally-black mode and the vertical alignment mode. Hereinafter, the results of the experiments will be described. Table 2 below shows the values of $V_{LC}$, $C_{LC}$ and $C_S$ in black display, 50% halftone display and white display, which are invariant values determined by the construction of the liquid crystal display apparatus. Table 2 also shows the value of $\Delta_{max}$ and the values of $V_S$ and $V_S'$ in still-image display of the above display variations, calculated using the above values, which were calculated based on the relational expressions (18), (12) and (13), respectively. Note that the unit of the voltages is volt (V) and the capacitance values are standardized values with respect to the capacitance $C_{LC}$ in black display as 1.000.

TABLE 2

| Display | Black | Halftone (50%) | White |
|---|---|---|---|
| $V_{LC}$ | 1.488 | 3.148 | 5.496 |
| $C_{LC}$ | 1.000 | 1.457 | 1.782 |
| $C_s$ | 1.426 | ← | ← |
| $\Delta_{max}$ | 2.532 | ← | ← |
| $V_s$ | −1.488 | 1.636 | 4.254 |
| $V_S'$ | 1.488 | 4.140 | 6.505 |

Tables 3 and 4 below show the values of $V_S$, $V_S'$, $V_{LC}$ and δV in moving-image displays from white to black, from black to halftone, from black to white, from halftone to black, from white to halftone, and from halftone to white, which were calculated based on the relational expressions (12), (14), (16) and (17), respectively.

TABLE 3

| | White → Black | Black → Halftone | Black → White |
|---|---|---|---|
| $V_S$ | −1.488 | 1.636 | 4.254 |
| $V_S'$ | 0.762 | 4.612 | 7.230 |
| $V_{LC}$ | 1.182 | 3.460 | 5.932 |
| δV | −0.306 | 0.312 | 0.436 |

TABLE 4

| | Halftone → Black | White → Halftone | Halftone → White |
|---|---|---|---|
| $V_S$ | −1.488 | 1.636 | 4.254 |
| $V_S'$ | 1.016 | 3.887 | 6.759 |
| $V_{LC}$ | 1.274 | 2.982 | 5.647 |
| δV | −0.214 | −0.166 | 0.151 |

From Tables 2 to 4, it is found that $V_{LC}$=1.488 (V) in black display of a still image is different from $V_{LC}$=1.182 (V) in display from white to black of a moving image, and therefore δV=−0.306 (V)≠0. $V_{LC}$ in the moving-image display will be the same as that in the still-image display if the potential $V_{CS}$ of the storage capacitor line is not changed. However, due to this difference of the voltage, charge transfer is facilitated.

Using the same liquid crystal display apparatus, the response times required to display a moving image were measured. That is, the response times required to display different gray-scale levels from start gray-scale levels of black, a halftone and white, that is, the response times required to display a moving image, were measured for the case of changing the potential of the storage capacitor line according to the present invention and for the conventional case of keeping the potential unchanged. Tables 5 and 6 show the results of the case of changing the potential and the conventional case, respectively.

TABLE 5

| | | End gray-scale level | | |
|---|---|---|---|---|
| | | Black | Halftone | White |
| Start gray-scale level | Black | / | 35 | 20 |
| | Halftone | 10 | / | — |
| | White | 11 | 24 | / |

Unit: ms

TABLE 6

| | | End gray-scale level | | |
|---|---|---|---|---|
| | | Black | Halftone | White |
| Start gray-scale level | Black | / | 22 | 12 |
| | Halftone | 7 | / | — |
| | White | 8 | 15 | / |

Unit: ms

From Tables 5 and 6, it is found that the response time in the moving-image display of any of the above combinations is shorter in the case of changing the potential of the storage capacitor line than in the conventional case of keeping the potential unchanged. This is presumably because $V_{LC}$ is different between the moving-image display and the still-image display in the former case, while it is the same in the latter case, and thus in the former case, charge transfer is facilitated in the moving-image display due to this voltage difference.

Next, the case of considering the parasitic capacitance $C_{gd}$ between the gate electrode 113*a* and the drain electrode 113*c* will be described.

In this case, according to the same theory used for the case of neglecting $C_{gd}$, the potential $V_S$ of the source signal is represented by relational expression (20):

$$V_S = \pm\sqrt{V_{LC}^2 - \left(\frac{C_S}{C_{total}}\cdot\Delta\right)^2} \mp \frac{C_S}{C_{total}}\cdot\Delta + \frac{C_{gd}}{C_{total}}(V_{gh} - V_{gl}) \tag{20}$$

where $C_{total}$ is equal to $C_{LC}+C_S+C_{gd}$, and $V_{gh}$ and $V_{gl}$ are the potentials of the gate electro 113*a* in the selected state and the non-selected state, respectively.

The potential $V_S'$ is represented by relational expression (21) below as in the case of neglecting $C_{gd}$.

$$V_S = V_S \pm \frac{2C_S}{C_{LC} + C_S}\cdot\Delta \tag{21}$$

The effective voltage value $V_{LC}$ applied to the LC capacitor $C_{LC}$ is also represented by relational expression (22) below as in the case of neglecting $C_{gd}$.

$$V_{LC} = \pm\sqrt{\frac{V_S^2 + V_S^2}{2}} \tag{22}$$

The value $\Delta_{max}$ maximizing the effect of accelerating the response of the liquid crystal molecules can be represented by relational expression (23) below.

$$\Delta_{\max} = \frac{C_{\mathrm{LC_min}} + C_S + C_{gd}}{C_S}\cdot V_{\mathrm{LC_min}} \tag{23}$$

Accordingly, in an occasion that the parasitic capacitance between the gate electrode 113*a* and the drain electrode 113*c* is not negligible, the potentials of the source signal, the storage capacitor line 115 (the other terminal of the storage capacitor $C_S$) and the counter common electrode 121 may be set based on the above expressions. By this setting, good response can be exhibited in the moving-image display.

<Driving Method 2 for Liquid Crystal Display Apparatus>

The second driving method for the liquid crystal display apparatus 100 will be described.

Figure 7:
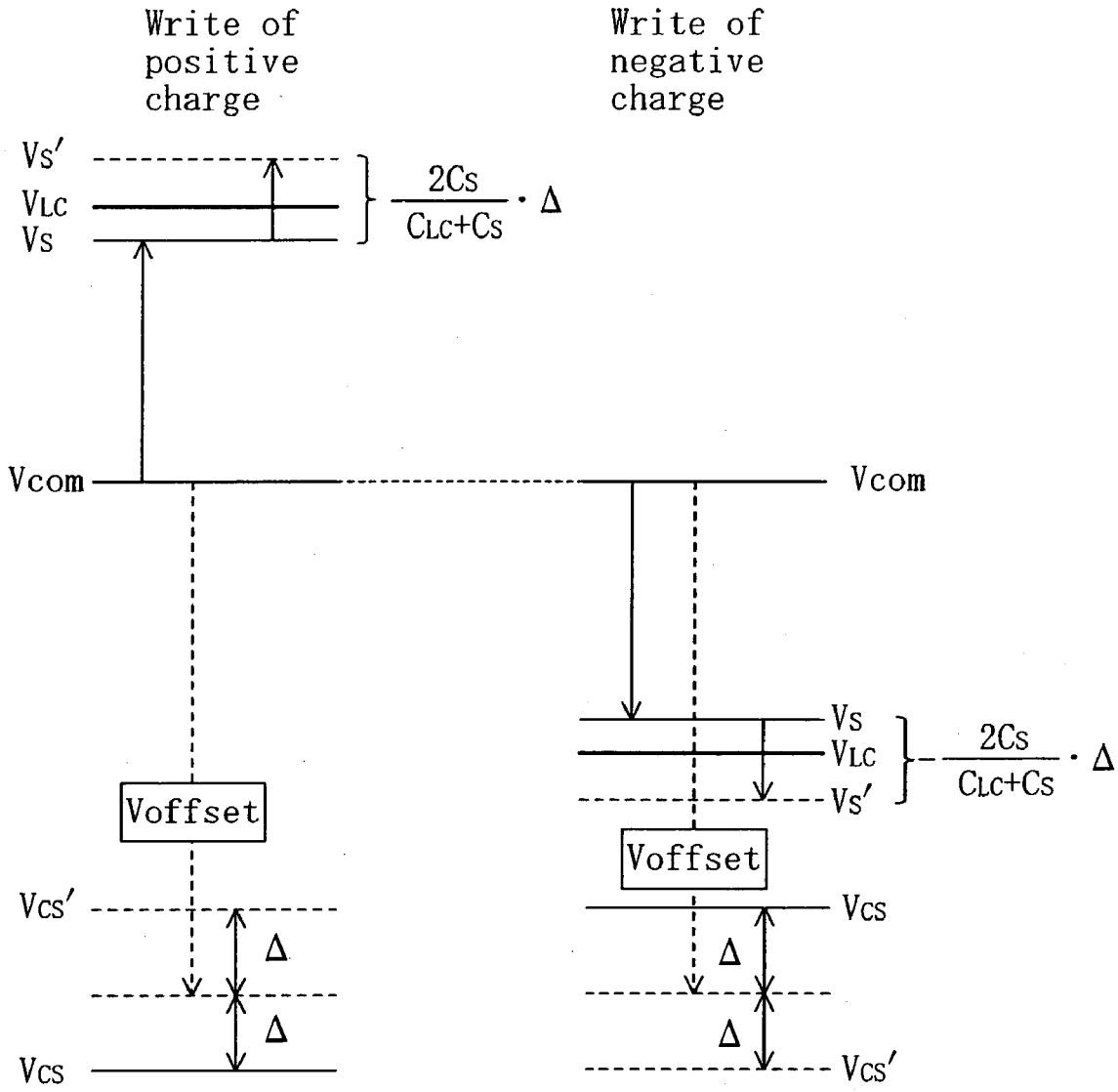
FIG. 7 is a view demonstrating a second driving method for the liquid crystal display apparatus of Embodiment 1.

As shown in FIG. 7, in the second driving method, the center of the potential $V_{CS}$ ($V_{CS}'$) of the storage capacitor line 115 is lowered by a value $V_{offset}$ from the potential $V_{com}$ of the grounded counter common electrode 121. Except for this point, this driving method is the same as the first driving method.

Although the potential $V_{CS}$ of the storage capacitor line 115 is offset, this driving method can provide the same function as the first driving method, and thus the same effect can be attained.

<Driving Method 3 for Liquid Crystal Display Apparatus>

The third driving method for the liquid crystal display apparatus 100 will be described.

Figure 8:
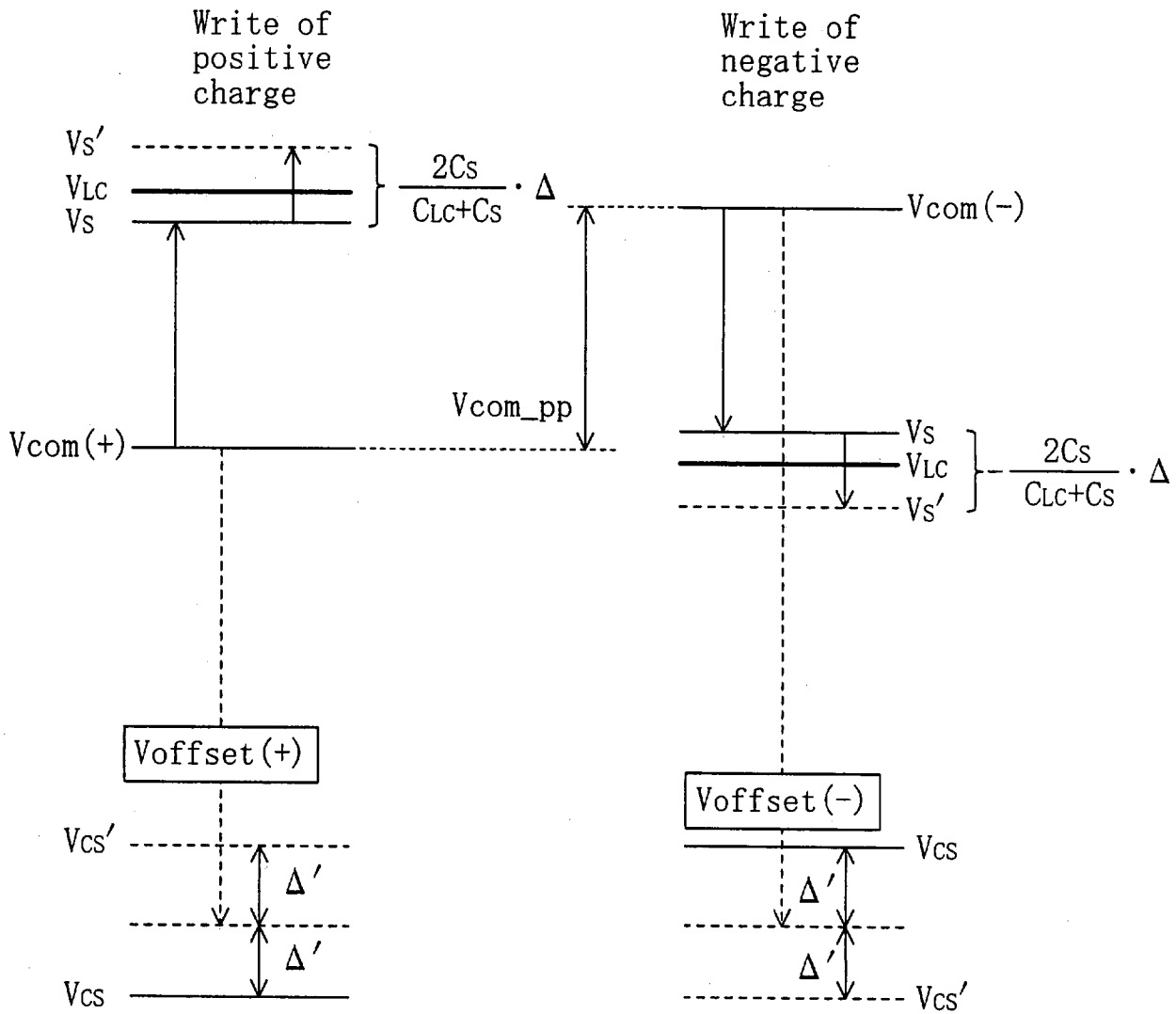
FIG. 8 is a view demonstrating a third driving method for the liquid crystal display apparatus of Embodiment 1.

As shown in FIG. 8, in the third driving method, the potential $V_{com}$ of the counter common electrode 121 is positive ($V_{com}(+)$) during writing of a positive charge, and negative ($V_{com}(-)$) during writing of a negative charge. That is, the potential $V_{com}$ has a shape of a rectangular wave fluctuating by a peak-to-peak voltage $V_{com_pp}$. In addition, the potential $V_{CS}$ of the storage capacitor line 115 has a shape of an AC rectangular wave of which the phase is reverse to that of the potential of the source signal, the center potential is lowered by a value $V_{offset}(+)$ from the $V_{com}(+)$ and by a value $V_{offset}(-)$ from the $V_{com}(-)$, and the amplitude is $\Delta'$ ($\Delta'>0$). Therefore, if $\Delta=\Delta'-V_{com_pp}/2$, the potential difference from the potential of the storage capacitor line 115 to the potential $V_{com}$ of the counter common electrode 121 is a square-wave signal voltage fluctuating by a peak-to-peak voltage of $2\Delta$.

This driving method also can provide the same function as the first driving method, and thus the same effect can be attained.

Embodiment 2

<Construction of Liquid Crystal Display Apparatus>

Figure 9:
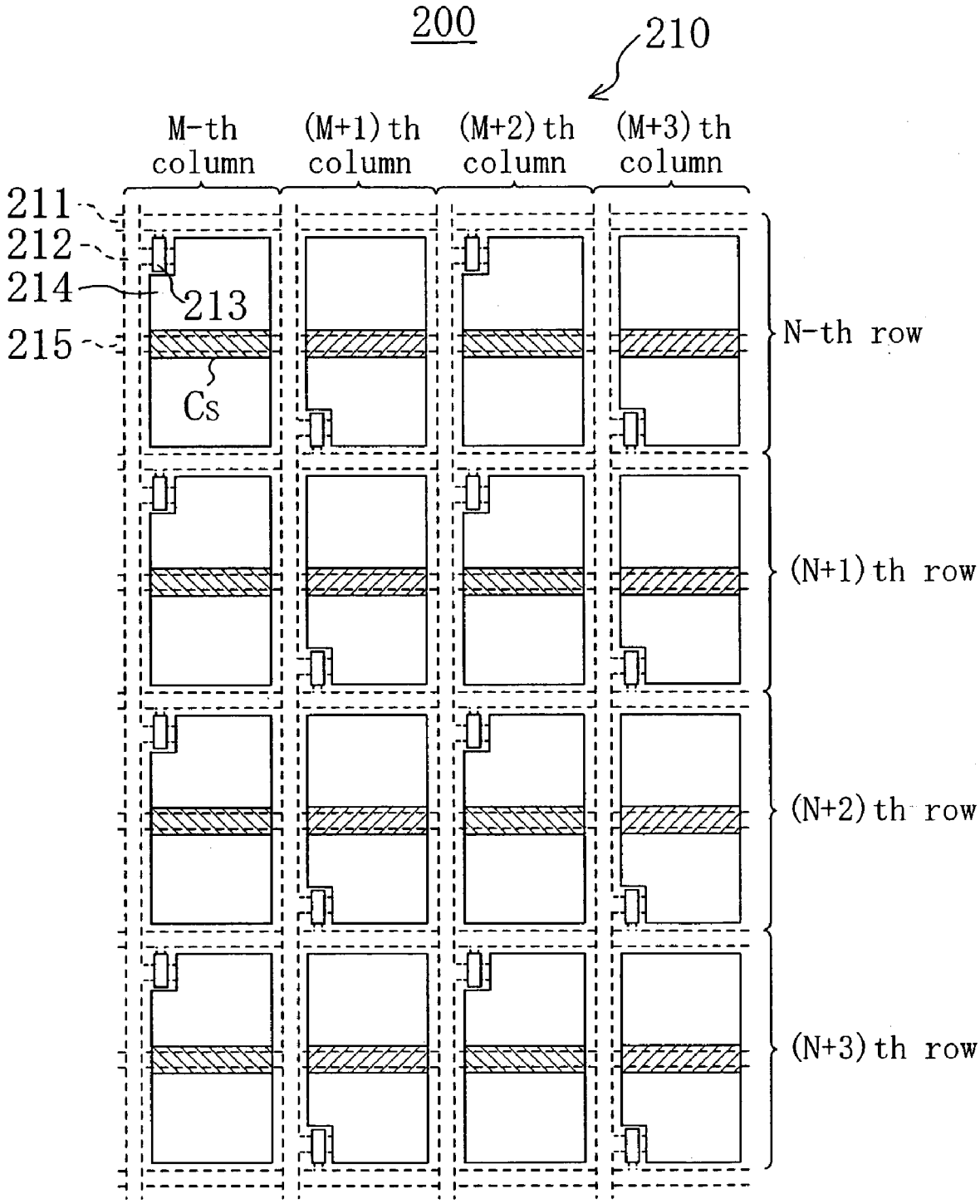
FIG. 9 is a front view of a TFT substrate of a liquid crystal display apparatus of Embodiment 2 of the present invention.
Figure 10:
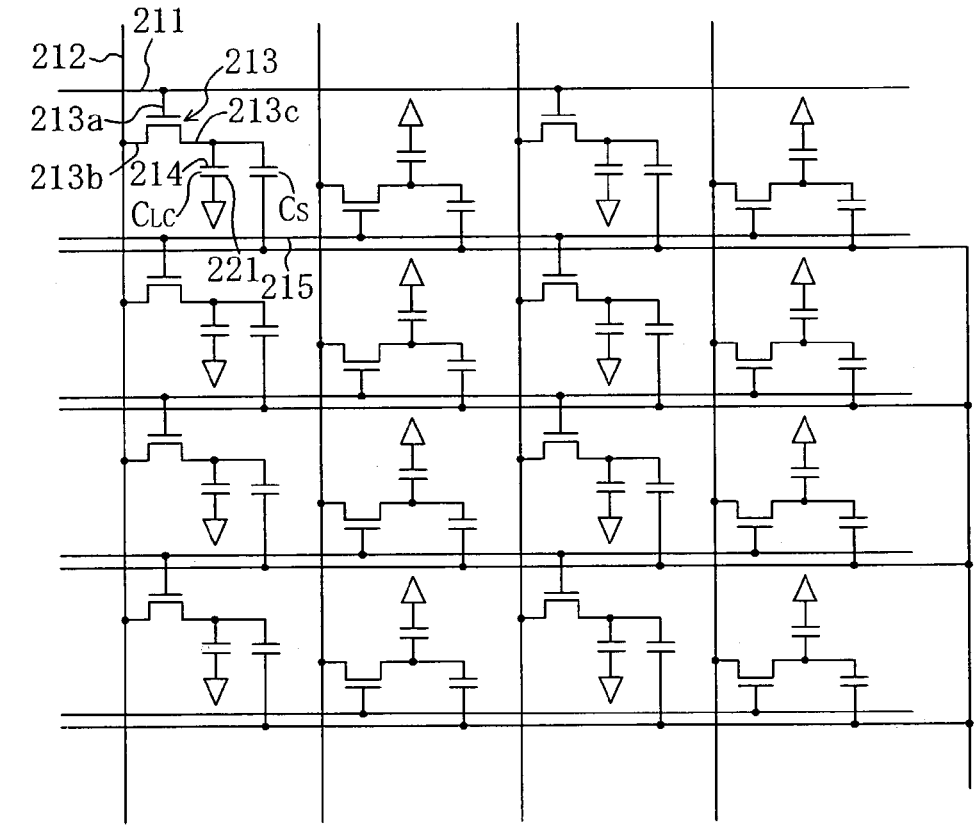
FIG. 10 is an equivalent circuit diagram of the liquid crystal display apparatus of Embodiment 2.

FIGS. 9 and 10 show a liquid crystal display apparatus 200 of Embodiment 2 of the present invention. In the liquid crystal display apparatus 200, as shown in FIGS. 9 and 10, for example, a pixel electrode 214 in the N-th row/M-th column is connected to the N-th gate line 211 corresponding to this pixel electrode 214 via a TFT 213, while a pixel electrode 214 in the N-th row/(M+1)th column is connected to the next (N+1)th gate line 211 that does not correspond to this pixel electrode 214 via a TFT 213. That is, the pixel electrodes 214 in the M-th, (M+2)th, . . . columns are connected to the corresponding gate lines 211, while the pixel electrodes 214 in the (M+1)th, (M+3)th, . . . columns are connected to the next non-corresponding gate lines 211. Therefore, in the direction of the running of the gate lines 211 (gate line direction), the pixel electrodes 214 connected to the corresponding gate line 211 and the pixel electrodes 214 connected to the next non-corresponding gate line 211 are placed alternately. The other part of the construction is the same as that in Embodiment 1.

<Driving Method for Liquid Crystal Display Apparatus>

Figure 11:
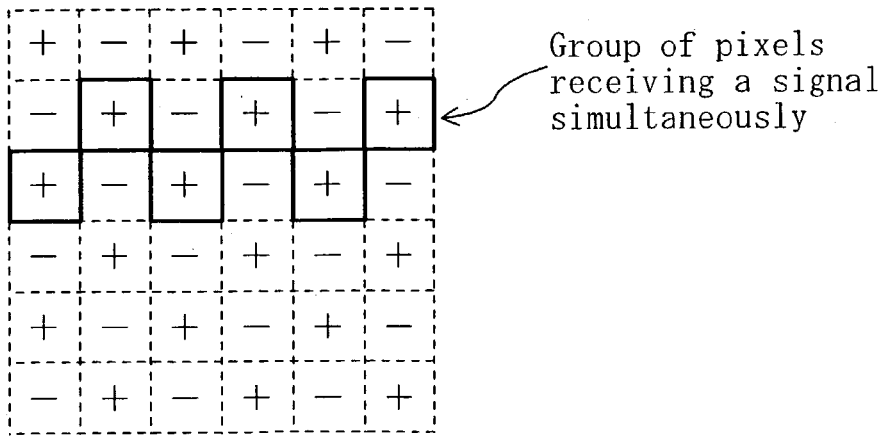
FIG. 11 is a view showing a charge polarity distribution after charging of pixel electrodes of one frame in Embodiment 2.

The liquid crystal display apparatus 200 of this embodiment operates in the following manner by adopting the AC drive and the H line reversal drive as in Embodiment 1. For example, when a gate signal is sent to the (N+2)th gate line 211, the TFTs 213 in the (N+2)th row are put into the selected state in the M-th, (M+2)th, . . . columns, while the TFTs 213 in the (N+1)th row are put into the selected state in the (M+1)th, (M+3)th, . . . columns, allowing charge to be written to the corresponding pixel electrodes 214. At this time, data for the pixel electrodes in the (N+2) row/(M+1)th, (M+3)th, . . . columns are held in a line memory. Suppose a positive charge has been written to the pixel electrodes 214 for the (N+2)th row. When the gate signal is sent to the next (N+3)th gate line 211, the TFTs 213 in the (N+3)th row are put into the selected state in the M-th, (M+2)th, . . . columns, and a negative charge is written to the corresponding pixel electrodes 214. In the (M+1)th, (M+3)th, . . . columns, the TFTs 213 in the (N+2)th row are put into the selected state, and a negative charge is written to the corresponding pixel electrodes 214. In other words, the TFTs 213 adjacent in the gate line direction are put into the selected state with a gate signal via different gate lines 211. As a result, charges of different polarities are written to the pixel electrodes 214 adjacent in the gate line direction. By combining this with the H line reversal drive, the charge polarity distribution after the charging of the pixel electrodes 214 of one frame is as shown in FIG. 11, in which charges of different polarities are written to the pixel electrodes 214 adjacent in the gate line direction and the source line direction. By this arrangement, occurrence of flickering in the gate line direction and the source line direction can be suppressed.

It is charges of the same polarity that are written to the pixel electrodes 214 simultaneously, and all the storage capacitor lines 215 are connected together. Therefore, good response is attained during display of a moving image by controlling the potential $V_{CS}$ of the storage capacitor lines 215 in the manner described in Embodiment 1.

Embodiment 3

<Construction of Liquid Crystal Display Apparatus>

Figure 12:
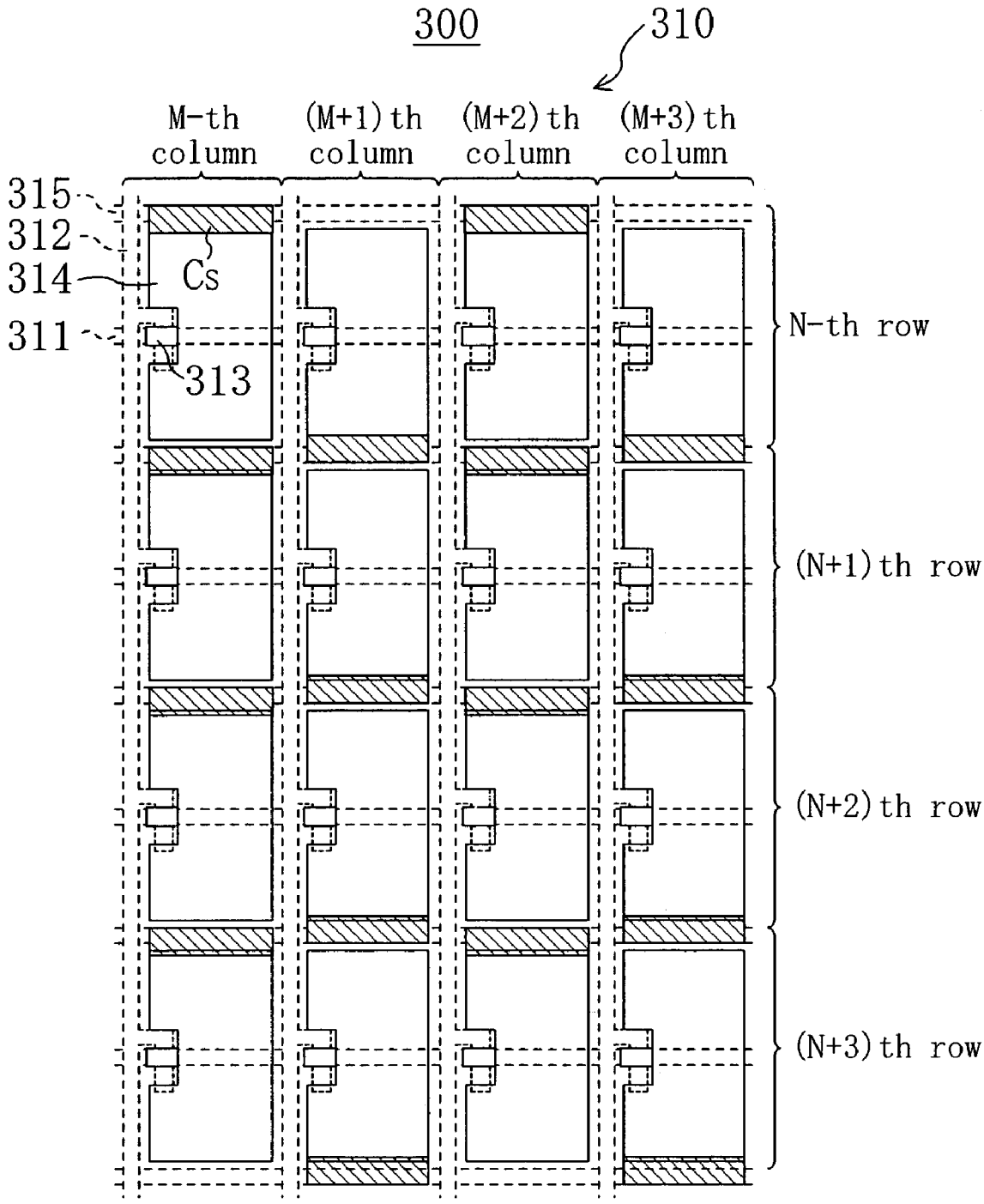
FIG. 12 is a front view of a TFT substrate of a liquid crystal display apparatus of Embodiment 3 of the present invention.
Figure 13:
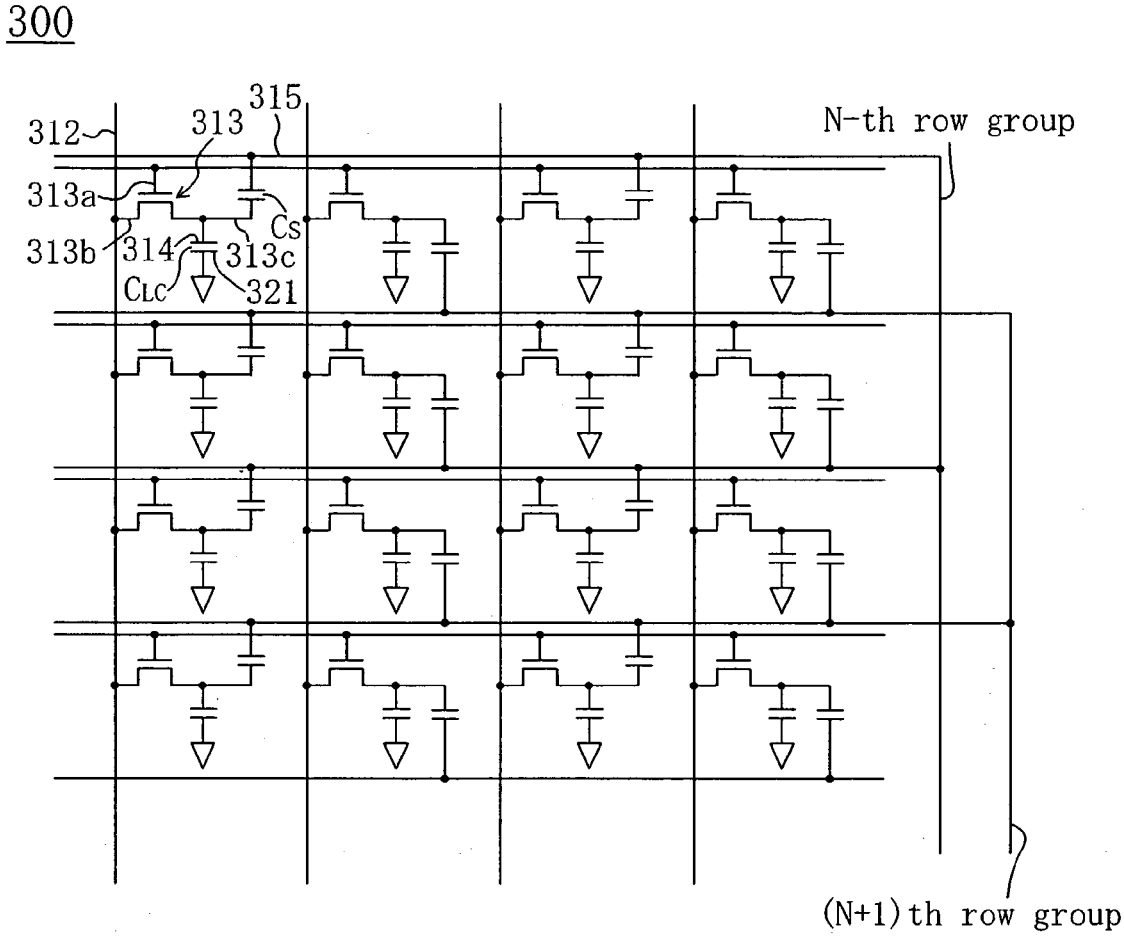
FIG. 13 is an equivalent circuit diagram of the liquid crystal display apparatus of Embodiment 3.
Figure 14:
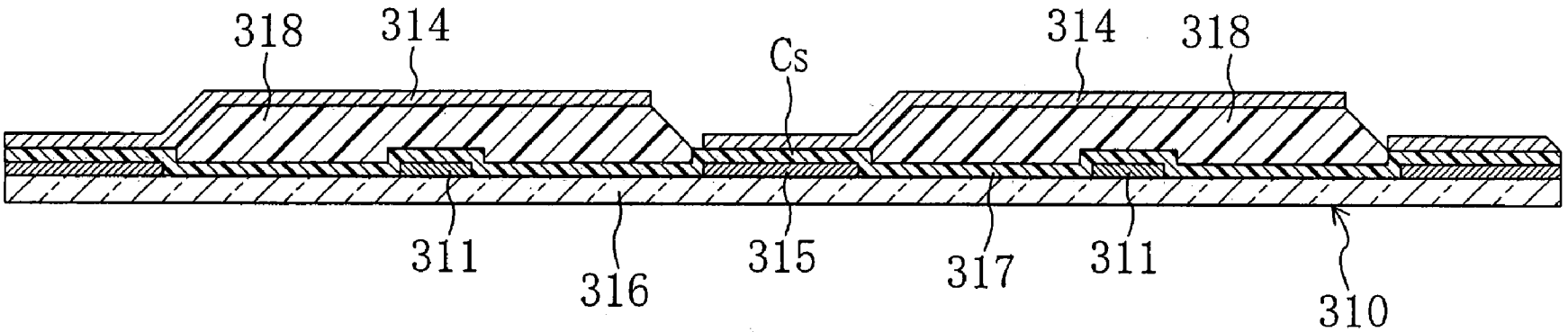
FIG. 14 is a partial cross-sectional view of the TFT substrate of the liquid crystal display apparatus of Embodiment 3.

FIGS. 12 and 13 show a liquid crystal display apparatus 300 of Embodiment 3 of the present invention. In the liquid crystal display apparatus 300, each pixel electrode 314 is defined by the area surrounded by two adjacent storage capacitor lines 315 and two adjacent source lines 312. A TFT 313 as the switching element is placed in the center of one major-side edge of the rectangle of each pixel electrode 314. As shown in FIGS. 12 and 13, for example, the minor-side edge portion of the pixel electrode 314 in the N-th row/M-th column overlaps the N-th storage capacitor line 315 corresponding to this pixel electrode 314, forming a storage capacitor $C_S$. As shown in FIG. 14, the storage capacitor $C_S$ is formed of a portion of a gate insulating film 317 interposed between the pixel electrode 314 and the storage capacitor line 315. On the contrary, the minor-side edge portion of the pixel electrode 314 in the N-th row/(M+1)th column overlaps the next (N+1)th storage capacitor line 315 that does not correspond to this pixel electrode 314, forming a storage capacitor $C_S$. That is, the pixel electrodes 314 in the M-th, (M+2)th, . . . columns form storage capacitors $C_S$ together with the corresponding storage capacitor lines 315, while the pixel electrodes 314 in the (M+1)th, (M+3)th, . . . columns form storage capacitors $C_S$ together with the next non-corresponding storage capacitor lines 315.

Therefore, in the direction of the running of the gate lines 311 (gate line direction), the pixel electrodes 314 forming storage capacitors $C_S$ together with the corresponding storage capacitor lines 315 and the pixel electrodes 314 forming storage capacitors $C_S$ together with the next non-corresponding storage capacitor lines 315 are placed alternately. The N-th, (N+2)th, . . . storage capacitor lines 315 are connected together, while the (N+1)th, (N+3)th, . . . storage capacitor lines 315 are connected together. That is, in this embodiment, the storage capacitor lines 315 are grouped into two: the N-th storage capacitor line group and the (N+1)th storage capacitor line group. On a substrate body 316, the pixel electrodes 314 are placed over the corresponding gate lines 311 with a transparent resin film 318 with a low dielectric constant (for example, relative dielectric constant: 3, thickness: 3 μm) interposed there between. This blocks formation of a capacitance between the pixel electrodes 314 and the gate lines 311, and thus enables writing of a normal charge to the pixel electrodes 314.

The other part of the construction is the same as that in Embodiment 1.

<Driving method of liquid crystal display apparatus>

Figure 15A:
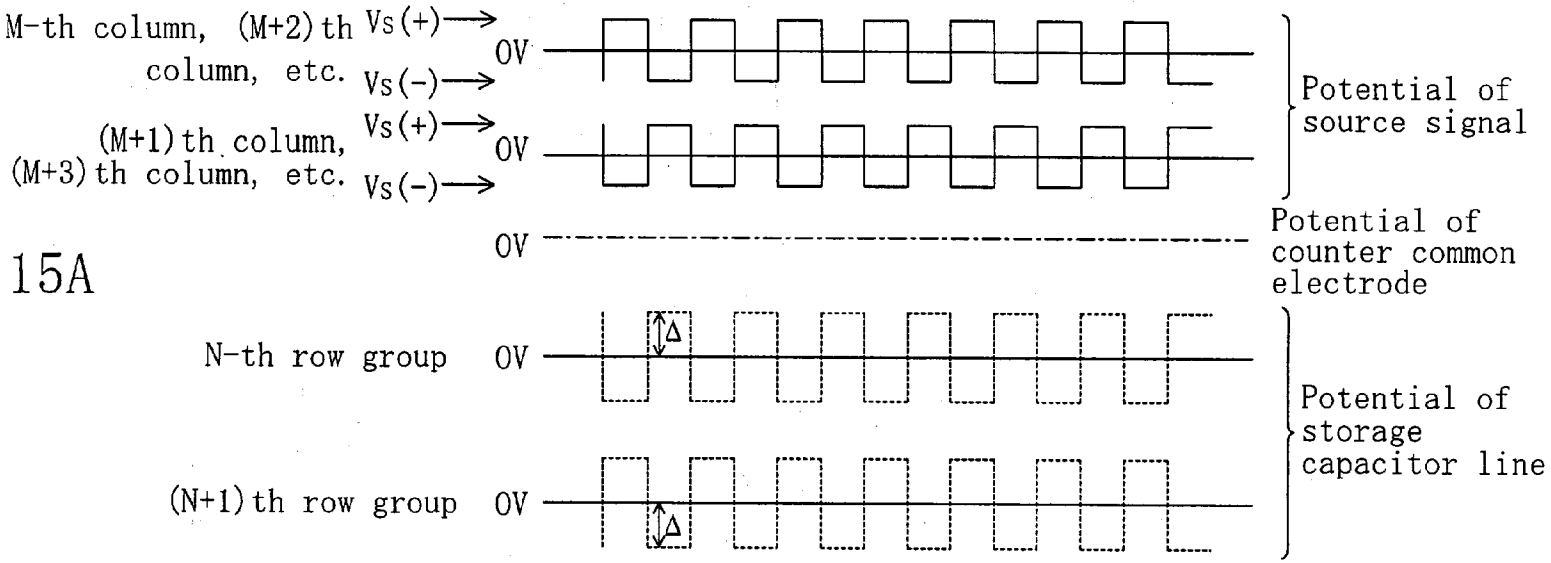
FIG. 15A is a diagram of waveforms of the potentials of a source line, a storage capacitor line and a counter common electrode.
Figure 15B:
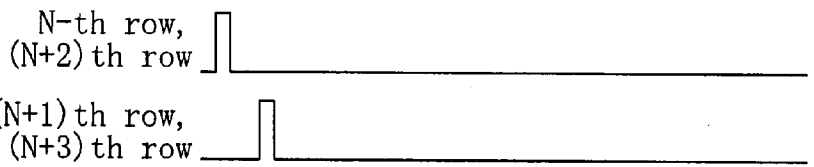
FIG. 15B is a diagram of waveforms of the potentials of the N-th and (N+1)th gate lines.
Figure 15C:
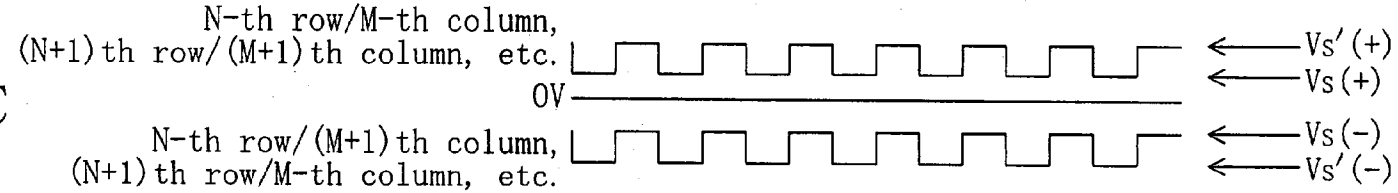
FIG. 15C is a diagram of waveforms of the voltages applied between pixel electrodes and the counter common electrode.

FIG. 15A shows waveforms of the potential $V_S$ of the source line 312, the potential $V_{CS}$ of the storage capacitor line 315, and the potential $V_{com}$ of the counter common electrode 321. FIG. 15B shows waveforms of the potentials of the N-th to (N+3)th gate lines 311. FIG. 15C shows waveforms of the voltages applied between the pixel electrodes-314 and the counter common electrode 321.

The driving method of this embodiment also adopts the AC drive and the H line reversal drive as in Embodiment 1. In addition, as shown in FIG. 15A, the source signal sent to the M-th, (M+2)th, . . . columns is the opposite in polarity to the source signal sent to the (M+1)th, (M+3)th, . . . columns. Therefore, as shown in FIGS. 15A and 15B, when a gate signal is sent to the N-th gate line 311, for example, a positive charge is written to the pixel electrodes 314 in the M-th, (M+2)th, . . . columns while a negative charge is written to the pixel electrodes 314 in the (M+1)th, (M+3)th, . . . columns. When a gate signal is sent to the (N+1)th gate line 311 next, a negative charge is written to the pixel electrodes 314 in the M-th, (M+2)th, . . . columns while a positive charge is written to the pixel electrodes 314 in the (M+1)th, (M+3)th, . . . columns.

Figure 16:
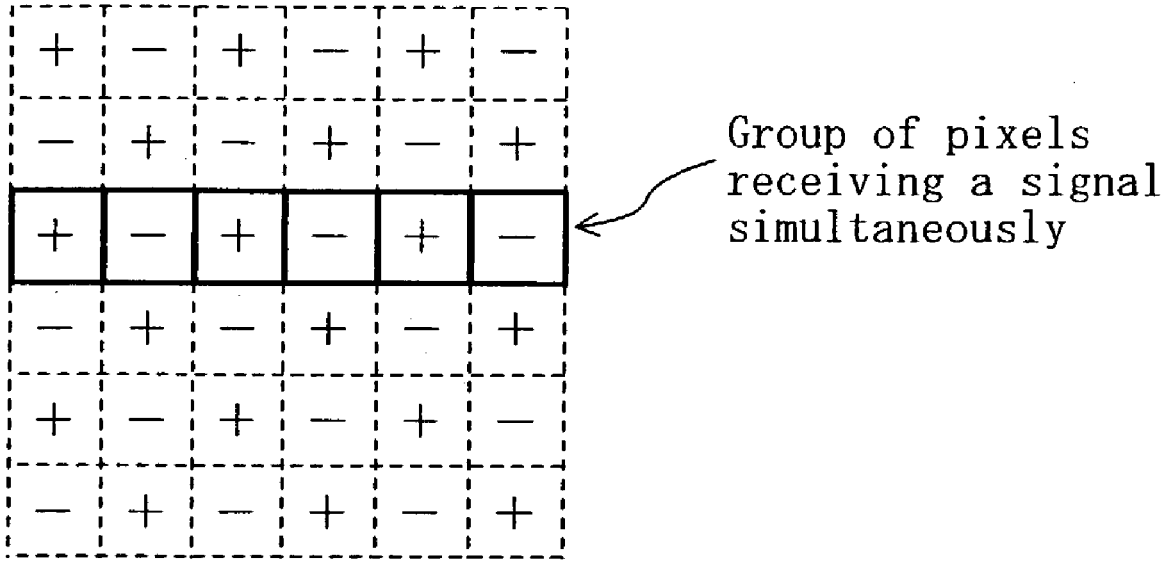
FIG. 16 is a view showing a charge polarity distribution after charging of pixel electrodes of one frame in Embodiment 3.

To state things differently, the TFTs 313 arranged along each gate line 311 are put into the selected state with a gate signal via the same gate line 311, and via the TFTs 313 in the selected state, source signals opposite in phase are sent to the adjacent pixel electrodes 314 arranged in correspondence with the TFTs 313. In this way, charges of different polarities are written to the adjacent pixel electrodes 314 in the gate line direction. By combining this with the H line reversal drive, the charge polarity distribution after the charging of the pixel electrodes 314 of one frame is as shown in FIG. 16, in which charges of different polarities are written to the pixel electrodes 314 adjacent in both the gate line direction and the source line direction. By this arrangement, occurrence of flickering in the gate line direction and the source line direction can be suppressed.

In addition, in this embodiment, the TFTs 313 arranged along each gate line 311 are put into the selected state with a gate signal via the same gate line 311. That is, the writing of a charge to the pixel electrodes 314 corresponding to these TFTs 313 is performed simultaneously. This eliminates the necessity of a line memory, which will be necessary when the TFTs 313 arranged along each gate line 311 are divided into groups to be put into the selected state with a gate signal via different gate lines 311.

In the liquid crystal display apparatus 300 having the construction described above, the storage capacitor lines 315, connected with the other terminals of the storage capacitors $C_S$ corresponding to the pixel electrodes 314 to which charges of the same polarity are written during the charging of the pixel electrodes 314 of one frame, are substantially grouped together to be connected with one another. The potential $V_{CS}$ of the storage capacitor line 315, that is, the potential of the other terminal of the storage capacitor $C_S$ has a shape of a rectangular wave as shown in FIG. 15A, and the counter common electrode 321 is grounded. Therefore, the potential difference from the potential $V_{CS}$ of the storage capacitor line 315 to the potential $V_{com}$ of the counter common electrode 321 is an AC square-wave signal voltage having an amplitude equal to that of the potential $V_{CS}$ of the storage capacitor line 315.

In each pixel, the source signal sent to the pixel electrode 314 and the above AC potential difference are opposite in phase to each other. Therefore, as shown in FIG. 15C, for example, the voltages $V_S$ and $V_S'$ of the positive polarity are alternately applied between the pixel electrodes 314 in the N-th row/M-th column and the (N+1)th row/(M+1)th column, to which a positive charge is written, and the counter common electrode 321, while the voltages $V_S$ and $V_S'$ of the negative polarity are alternately applied between the pixel electrodes 314 in the N-th row/(M+1)th column and the (N+1)th row/M-th column, to which a negative charge is written, and the counter common electrode 321. Thus, in each pixel, good response is attained during the moving-image display by controlling the potential of the other terminal of the storage capacitor $C_S$ in the same manner as that in Embodiments 1 and 2.

Embodiment 4

<Construction of Liquid Crystal Display Apparatus>

Figure 17:
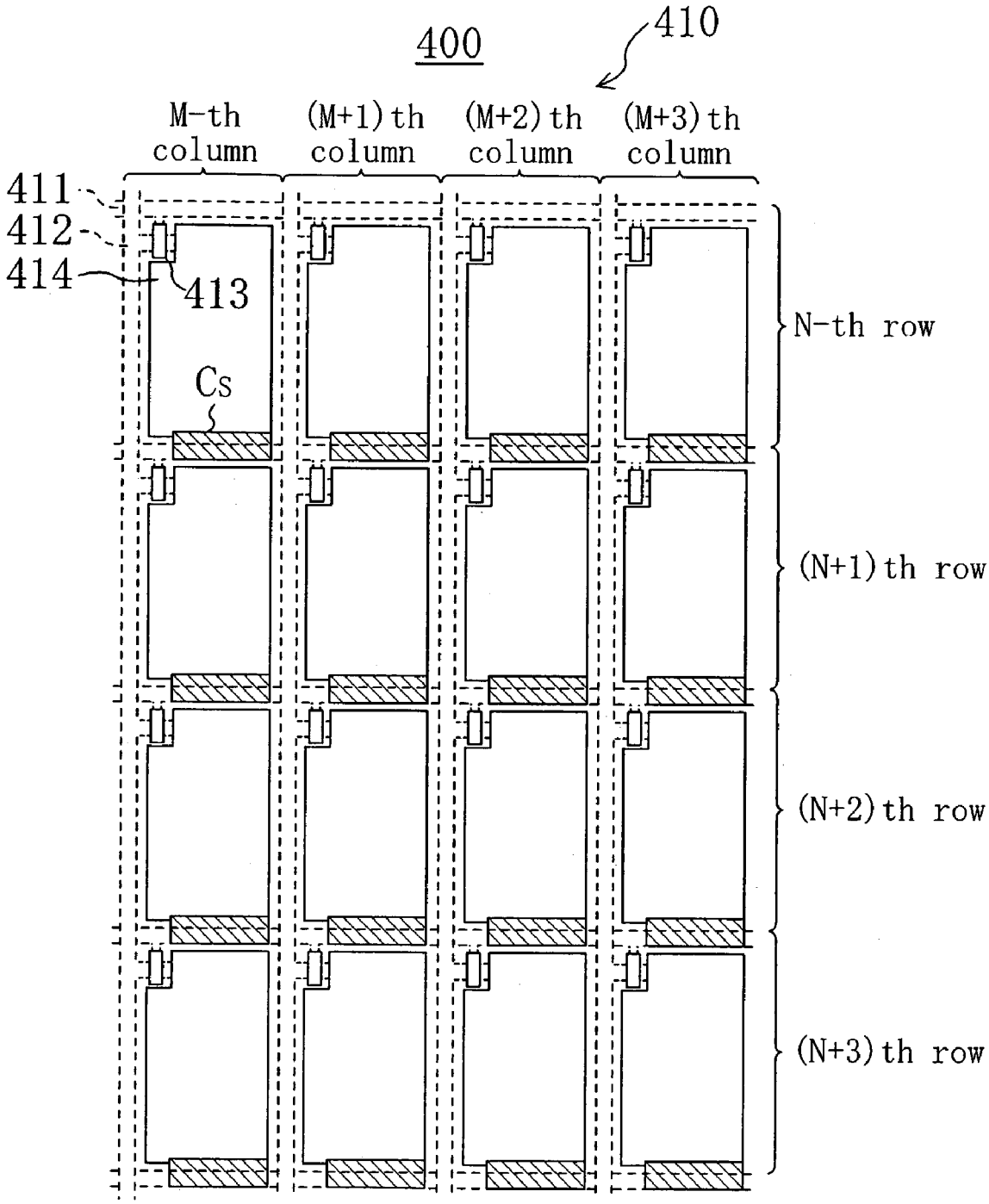
FIG. 17 is a front view of a TFT substrate of a liquid crystal display apparatus of Embodiment 4 of the present invention.
Figure 18:
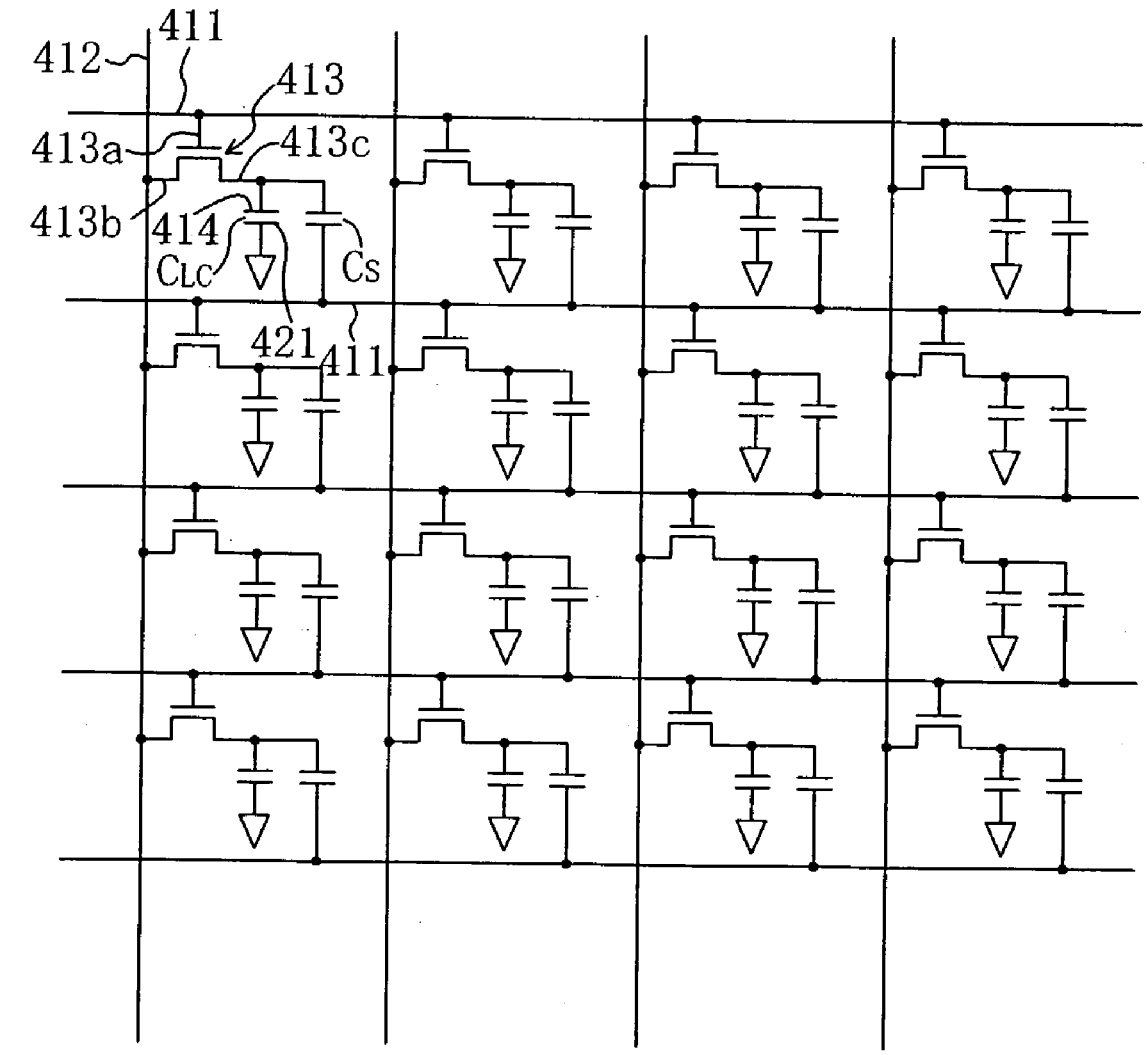
FIG. 18 is an equivalent circuit diagram of the liquid crystal display apparatus of Embodiment 4.

FIGS. 17 and 18 show a liquid crystal display apparatus 400 of Embodiment 4 of the present invention. In the liquid crystal display apparatus 400, as shown in FIGS. 17 and 18, for example, the minor-side edge portion of each pixel electrode 414 in the N-th row overlaps the (N+1)th gate line 411, forming a storage capacitor $C_S$ there between. No independent storage capacitor line is provided in this embodiment. That is, the liquid crystal display apparatus 400 is of the $C_S$-on-gate type.

The other part of the construction is the same as that in Embodiment 1.

<Driving Method for Liquid Crystal Display Apparatus>

In the liquid crystal display apparatus 400, the potential of the storage capacitor line shown in FIGS. 7 and 8 is replaced with the potential of the gate line 411 in the row next to the row corresponding to the current pixel electrodes 414 to be charged, and the potential of the gate line 411 is adjusted to be a non-selection potential (typically −15 V to −5 V, for example) by adjusting an offset voltage, to thereby enable substantially the same driving as that in Embodiment 1. In this way, good response is attained during display of a moving image.

It should be noted that although various illustrative embodiments of the present application have been described, the present invention is not limited to these illustrative embodiments. For example, embodiments have been described wherein the potential $V_{CS}$ of the storage capacitor line (that is, the potential of the other terminal of the storage capacitor $C_S$) has a shape of an AC rectangular wave, of which the phase is reverse to that of the potential of the source signal $V_S$. The center potential has equated to 0 V (equal to the potential $V_{com}$ of the counter common electrode) and the amplitude is $\Delta(\Delta>0)$. The potential difference from the potential $V_{CS}$ of the storage capacitor line to the potential $V_{com}$ of the counter common electrode has been represented by an AC square-wave signal voltage fluctuating between $+\Delta$ and $-\Delta$. However, the invention is not limited as such, as it applies (with regard to each of the embodiments described) to others methods for generating such a delta $\Delta$, including but not limited to varying the potential $V_{com}$ of the counter common electrode in an alternating fashion in the shape of an AC rectangular wave, in relation to a constant or 0 V potential of the storage line capacitor $C_S$. Further, it applies to any method wherein the absolute value of the potential of $V_{CS}$ and $V_{com}$ alternates in the shape of an AC rectangular wave, of which the phase is reverse to that of the potential of the source signal $V_S$.

While the present invention has been described in preferred embodiments, it will be apparent to those skilled in the art that the disclosed invention may be modified in numerous ways and may assume many embodiments other than that specifically set out and described above. Accordingly, it is intended by the appended claims to cover all modifications of the invention which fall within the true spirit and scope of the invention.

What is claimed is:

1. A driving method for an active matrix liquid crystal display apparatus including a plurality of gate lines, a plurality of source lines crossing the plurality of gate lines for carrying a source signal, a plurality of pixel electrodes at respective crossings of the gate lines and the source lines, wherein each of the pixel electrodes includes a switching element connected thereto, a liquid crystal capacitor and a storage capacitor, the liquid crystal display apparatus further including a counter electrode and a liquid crystal layer, the method comprising:

setting potentials of the source signal, a terminal of the storage capacitor and the counter electrode such that a potential difference from the potential of a terminal of the storage capacitor to the potential of the counter electrode varies repeatedly; and determining an absolute value of a first voltage applied between the pixel electrode and the counter electrode when the potential difference is the same as that during writing of a charge to the pixel electrode, and determining an absolute value of a second voltage applied between the pixel electrode and the counter electrode when the potential difference is different from that during writing of a charge to the pixel electrode, such that an effective voltage is adapted to be applied to the liquid crystal capacitor during display of a moving image of a gray-scale level that is different from an effective voltage applied to the liquid crystal capacitor during display of the a still image of the same gray-scale level.

2. A driving method for an active matrix liquid crystal display apparatus, adopting an AC drive system, including a plurality of gate lines, a plurality of source lines crossing the plurality of gate lines for carrying a source signal, a plurality of pixel electrodes at respective crossings of the gate lines and the source lines, wherein each of the pixel electrodes includes a switching element connected thereto, a liquid crystal capacitor and a storage capacitor, the liquid crystal display apparatus further including a counter electrode and a liquid crystal layer, the method comprising:

setting potentials of the source signal, a terminal of the storage capacitor and the counter electrode such that a potential difference from the potential of a terminal of the storage capacitor to the potential of the counter electrode varies repeatedly; and determining an absolute value of a first voltage applied between the pixel electrode and the counter electrode when the potential difference is the same as that during writing of a charge to the pixel electrode that is at most equal to the absolute value of a second voltage applied between the pixel electrode and the counter electrode when the potential difference is different from that during writing of a charge to the pixel electrode.

3. The method of claim 2, wherein the potentials of a terminal of the storage capacitor and the counter electrode are set such that the potential difference from the potential of a terminal of the storage capacitor to the potential of the counter electrode forms a waveform, wherein a relatively low part of the waveform corresponds to writing of a positive charge to the pixel electrode and a relatively high part of the waveform corresponds to writing of a negative charge to the pixel electrode.

4. The method of claim 3, wherein the potential difference from the potential of a terminal of the storage capacitor to the potential of the counter electrode is set to have a frequency to which the liquid crystal molecules of the liquid crystal layer cannot respond.

5. The method of claim 4, wherein the frequency of the potential difference is the same as a horizontal frequency of the liquid crystal display apparatus.

6. The method of claim 3, wherein when the potentials of a terminal of the storage capacitor and the counter electrode are set so that the amplitude of the waveform of the potential difference is $\Delta(\Delta>0)$, the potential of the source signal is set so that relational expression (1) below representing a potential difference $V_S$ between the potential of the source signal and the potential of the counter electrode is satisfied during writing of a positive charge to the pixel electrode and so that relational expression (2) below representing the potential difference $V_S$ is satisfied during writing of a negative charge to the pixel electrode:

$$V_s = \sqrt{V_{LC}^2 - \left(\frac{C_S}{C_{LC}+C_S}\cdot\Delta\right)^2} - \frac{C_S}{C_{LC}+C_S}\cdot\Delta \tag{1}$$

$$V_s = -\sqrt{V_{LC}^2 - \left(\frac{C_S}{C_{LC}+C_S}\cdot\Delta\right)^2} + \frac{C_S}{C_{LC}+C_S}\cdot\Delta \tag{2}$$

where $C_{LC}$ is the capacitance of the liquid crystal capacitor, $V_{LC}$ is a voltage to be applied in correspondence with $C_{LC}$, and $C_S$ is the capacitance of the storage capacitor.

7. The method of claim 6, wherein the potentials of a terminal of the storage capacitor and the counter electrode are set so that the amplitude $\Delta$ of the waveform of the potential difference satisfies relational expression (3):

$$\Delta = \frac{C_{\mathrm{LC_min}} + C_S}{C_S}\cdot V_{\mathrm{LC_min}} \tag{3}$$

where $C_{LC_min}$ is the minimum capacitance of the liquid crystal capacitor and $V_{LC_min}$ is a voltage to be applied in correspondence with $C_{LC_min}$.

8. The method of claim 3, wherein the switching element is a thin film transistor having a gate electrode, a source electrode and a drain electrode connected to the gate line, the source line and the pixel electrode, respectively, and wherein when the potentials of a terminal of the storage capacitor and the counter electrode are set so that the amplitude of the waveform of the potential difference $\Delta(\Delta>0)$, the potential of the source signal is set so that relational expression (4) below representing a potential difference $V_S$ between the potential of the source signal and the potential of the counter electrode is satisfied during writing of a positive charge to the pixel electrode and so that relational expression (5) below representing the potential difference $V_S$ is satisfied during writing of a negative charge to the pixel electrode:

$$V_s = \sqrt{V_{LC}^2 - \left(\frac{C_S}{C_{total}}\cdot\Delta\right)^2} - \frac{C_S}{C_{total}}\cdot\Delta + \frac{C_{gd}}{C_{total}}(V_{gh} - V_{gl}) \tag{4}$$

$$V_s = -\sqrt{V_{LC}^2 - \left(\frac{C_S}{C_{total}}\cdot\Delta\right)^2} + \frac{C_S}{C_{total}}\cdot\Delta + \frac{C_{gd}}{C_{total}}(V_{gh} - V_{gl}) \tag{5}$$

where $C_{LC}$ is the capacitance of the liquid crystal capacitor, $V_{LC}$ is a voltage to be applied in correspondence with $C_{LC}$, $C_S$ is the capacitance of the storage capacitor, $C_{gd}$ is a parasitic capacitance between the gate electrode and the drain electrode, $C_{total}$ is equal to $C_{LC}+C_S+C_{gd}$, $V_{gh}$ is a potential of the gate electrode in the selected state, and $V_{gl}$ is a potential of the gate electrode in the non-selected state.

9. The method of claim 8, wherein the potentials of a terminal of the storage capacitor and the counter electrode are set so that the amplitude $\Delta$ of the waveform of the potential difference satisfies relational expression (6):

$$\Delta = \frac{C_{\mathrm{LC_min}} + C_S + C_{gd}}{C_S}\cdot V_{\mathrm{LC_min}} \tag{6}$$

where $C_{LC_min}$ is the minimum capacitance of the liquid crystal capacitor and $V_{LC_min}$ is a voltage to be applied in correspondence with $C_{LC_min}$.

10. The method of claim 2, wherein the liquid crystal display apparatus is of a $C_S$-on-common type having a storage capacitor line to which a terminal of the storage capacitor is connected.

11. The method of claim 10, wherein in the liquid crystal display apparatus, terminals of the storage capacitors arranged along each gate line are connected to the same storage capacitor line, while the switching elements adjacent in the direction of the gate lines are connected to different gate lines, and wherein during charging of the pixel electrodes of one frame, charges of different polarities are written to the pixel electrodes adjacent in the direction of the gate lines by putting the switching elements adjacent in the direction of the gate lines into a selected state with a gate signal via different gate lines.

12. The method of claim 10, wherein in the liquid crystal display apparatus, the switching elements arranged along each gate line are connected to the same gate line, while terminals of the storage capacitors adjacent in the direction of the gate lines are connected to different storage capacitor lines, and during charging of the pixel electrodes of one frame, charges of different polarities are written to the pixel electrodes adjacent in the direction of the gate lines by putting the switching elements arranged along the gate line into the selected state with a gate signal of the same gate line and sending source signals opposite in phase to the adjacent pixel electrodes placed in correspondence with the switching elements.

13. The method of claim 12, wherein in the liquid crystal display apparatus, terminals of the storage capacitors corresponding to the pixel electrodes to which charges of the same polarity are written during charging of the pixel electrodes of one frame, are connected together via a storage capacitor line.

14. The method of claim 12, wherein in the liquid crystal display apparatus, the storage capacitor line is placed between every two adjacent gate lines, one terminal of each of the storage capacitors is connected to an edge of the corresponding pixel electrode, a terminal of the storage capacitor is connected to the corresponding storage capacitor line, and the pixel electrode is formed over the gate line with an insulating film interposed between the pixel electrode and the gate line for blocking formation of a capacitance between the pixel electrode and the gate line.

15. The method of claim 2, wherein the liquid crystal display apparatus is of a $C_S$-on-gate type in which a terminal of the storage capacitor is connected to a gate line other than the gate line corresponding to the storage capacitor.

16. An active matrix liquid crystal display apparatus, comprising:

a device including a plurality of gate lines for sequentially carrying a gate signal, a plurality of source lines crossing the plurality of gate lines for carrying a source signal, a plurality of pixel electrodes corresponding to respective crossings of the gate lines and the source lines, each of the pixel electrodes including a switching element, and a plurality of storage capacitors associated with a respective pixel electrodes, wherein one terminal of each storage capacitor is connected to a corresponding pixel electrode;

a counter electrode facing the device;

a liquid crystal layer including liquid crystal molecules, placed between the device and the counter electrode; and a liquid crystal capacitor formed between each pixel electrode and the counter electrode, wherein potentials of the source signal, the other terminal of the storage capacitor and the counter electrode are set such that a potential difference from the potential of the other terminal of the storage capacitor to the potential of the counter electrode varies repeatedly, and wherein the absolute value of a first voltage applied between the pixel electrode and the counter electrode when the potential difference is the same as that during writing of a charge to the pixel electrode and the absolute value of a second voltage applied between the pixel electrode and the counter electrode when the potential difference is different from that during writing of a charge to the pixel electrode is determined to provide an effective voltage applied to the liquid crystal capacitor during display of a moving image of a gray-scale level that is different from an effective voltage applied to the liquid crystal capacitor during display of a still image of the gray-scale level.

17. An active matrix liquid crystal display apparatus adopting an AC drive system, comprising:

a device-side substrate comprising a plurality of gate lines for sequentially carrying a gate signal, a plurality of source lines crossing the plurality of gate lines for carrying a source signal, a plurality of pixel electrodes corresponding to respective crossings of the gate lines and the source lines, each of the pixel electrodes including a switching element, and a plurality of storage capacitors associated with a respective pixel electrode, wherein one terminal of each storage capacitor is connected to a corresponding pixel electrode;

a counter substrate comprising a counter electrode, placed to face the device-side substrate;

a liquid crystal layer including liquid crystal molecules, interposed between the device-side substrate and the counter substrate; and a liquid crystal capacitor formed between each pixel electrode and the counter electrode, wherein potentials of the source signal, the other terminal of the storage capacitor and the counter electrode are set so that a potential difference from the potential of the other terminal of the storage capacitor to the potential of the counter electrode varies repeatedly and wherein the absolute value of a first voltage applied between the pixel electrode and the counter electrode when the potential difference is the same as that during writing of a charge to the pixel electrode is at most equal the absolute value of a second voltage applied between the pixel electrode and the counter electrode when the potential difference is different from that during writing of a charge to the pixel electrode.

18. The apparatus of claim 17, wherein the liquid crystal display apparatus is of a $C_S$-on-common type having a storage capacitor line to which the other terminal of the storage capacitor is connected.

19. The apparatus of claim 18, wherein the other terminals of the storage capacitors arranged along each gate line are connected to the same storage capacitor line, while the switching elements adjacent to the gate lines are connected to different gate lines, and wherein, during charging of the pixel electrodes of one frame, charges of different polarities are written to the pixel electrodes adjacent in the direction of the gate lines by putting the switching elements adjacent the gate lines into the selected state with a gate signal via different gate lines.

20. The apparatus of claim 18, wherein the switching elements arranged along each gate line are connected to the same gate line, while the other terminals of the storage capacitors adjacent in the direction of the gate lines are connected to different storage capacitor lines, and wherein, during charging of the pixel electrodes of one frame, charges of different polarities are written to the pixel electrodes adjacent in the direction of the gate lines by putting the switching elements arranged along the gate line into the selected state with a gate signal of the same gate line and sending source signals opposite in phase to the adjacent pixel electrodes placed in correspondence with the switching elements.

21. The method of claim 20, wherein all of the other terminals of the storage capacitors corresponding to the pixel electrodes to which charges of the same polarity are written during charging of the pixel electrodes of one frame are connected together via a storage capacitor line.

22. The apparatus of claim 20, wherein the storage capacitor line is placed between every two adjacent gate lines, one terminal of each of the storage capacitors is connected to an edge of the corresponding pixel electrode, the other terminal of the storage capacitor is connected to the corresponding storage capacitor line, and the pixel electrode is formed over the gate line with an insulating film interposed between the pixel electrode and the gate line for blocking formation of a capacitance between the pixel electrode and the gate line.

23. The apparatus of claim 17, wherein the liquid crystal display apparatus is of a $C_S$-on-gate type in which the other terminal of the storage capacitor is connected to a gate line other than the gate line corresponding to the storage capacitor.

24. The apparatus of claim 16, wherein the liquid crystal display apparatus is constructed so that when a gate signal is sent to a switching element via the corresponding gate line, the switching element is placed into a selected state, and when a source signal is sent via the corresponding source line to the pixel electrode corresponding to the switching element in the selected state, a charge is written to the pixel electrode to allow the liquid crystal capacitor formed between the pixel electrode and the counter electrode and the storage capacitor corresponding to the pixel electrode to be charged.

25. The apparatus of claim 17, wherein the liquid crystal display apparatus is constructed so that when a gate signal is sent to a switching element via the corresponding gate line, the switching element is placed into a selected state, and when a source signal is sent via the corresponding source line to the pixel electrode corresponding to the switching element in the selected state, a charge is written to the pixel electrode to allow the liquid crystal capacitor formed between the pixel electrode and the counter electrode and the storage capacitor corresponding to the pixel electrode to be charged.

26. The method of claim 1, wherein the potential of a terminal of the storage capacitor is that of a terminal of the storage capacitor, other than a terminal connected to a pixel electrode.

27. The method of claim 2, wherein the potential of a terminal of the storage capacitor is that of a terminal of the storage capacitor, other than a terminal connected to a pixel electrode.

* * * * *